US008549871B1

(12) United States Patent
Lauchnor et al.

(10) Patent No.: US 8,549,871 B1
(45) Date of Patent: Oct. 8, 2013

(54) MULTI TRAY REFRIGERATED CHEST FOR RAPIDLY QUENCHING BEVERAGES

(71) Applicants: John Lauchnor, West Simsbury, CT (US); Paul Dowd, Scarsdale, NY (US); Christopher Miller, Bronxville, NY (US)

(72) Inventors: John Lauchnor, West Simsbury, CT (US); Paul Dowd, Scarsdale, NY (US); Christopher Miller, Bronxville, NY (US)

(73) Assignee: John Lauchnor, West Simsbury, CT (US)

( * ) Notice: Subject to any disclaimer, the term of this patent is extended or adjusted under 35 U.S.C. 154(b) by 0 days.

(21) Appl. No.: 13/854,739

(22) Filed: Apr. 1, 2013

Related U.S. Application Data

(60) Provisional application No. 61/798,394, filed on Mar. 15, 2013, provisional application No. 61/745,033, filed on Dec. 21, 2012.

(51) Int. Cl.
*F25D 3/08* (2006.01)

(52) U.S. Cl.
USPC ..... 62/371; 62/457.2

(58) Field of Classification Search
USPC ..... 62/371, 372, 457.1, 457.2, 457.5, 457.7
See application file for complete search history.

(56) References Cited

U.S. PATENT DOCUMENTS

| | | | | |
|---|---|---|---|---|
| 2,470,551 | A | 5/1949 | Fish | |
| 4,725,492 | A | 2/1988 | Yazaki et al. | |
| 4,920,763 | A | 5/1990 | Provest et al. | |
| 5,237,835 | A | 8/1993 | Brochier | |
| 5,265,440 | A * | 11/1993 | Baker | 62/371 |
| 6,058,718 | A | 5/2000 | Forsberg et al. | |
| 7,165,415 | B2 | 1/2007 | Nam et al. | |
| 7,246,784 | B1 | 7/2007 | Lopez | |
| 7,703,301 | B2 * | 4/2010 | Loibl et al. | 62/376 |
| 7,886,547 | B2 * | 2/2011 | Sullivan | 62/93 |
| 8,161,769 | B2 * | 4/2012 | Lauchnor | 62/457.7 |
| 2006/0219858 | A1 | 10/2006 | Iacovino | |
| 2012/0198871 | A1 | 8/2012 | Lauchnor et al. | |

FOREIGN PATENT DOCUMENTS

| | | | |
|---|---|---|---|
| EP | 174170 | A2 | 3/1986 |
| JP | 2002168546 | A | 6/2002 |

* cited by examiner

*Primary Examiner* — Melvin Jones
(74) *Attorney, Agent, or Firm* — Day Pitney LLP

(57) ABSTRACT

The disclosure features various embodiments and aspects of a chest for quenching beverages. The chest can include a tank for holding a chilled mixture of ice and water, an ice maker adapted for making ice having an output for ejecting ice into a conduit in fluid communication with the tank, and a plurality of quench trays disposed above the tank for holding containers of beverages located in first and second positions. The trays can be filled with cold water by way of a conduit in fluid communication with the tank. The quench trays can include a compartment defined by a bottom and a plurality of walls, and defining therein a plurality of rows for aligning and containing a plurality of beverage containers. The drawers can further include at least one drain orifice configured to guide water out of the quench tray.

20 Claims, 16 Drawing Sheets

FIGURE 1 Cooler Chest – Isometric View Illustrating top and side doors

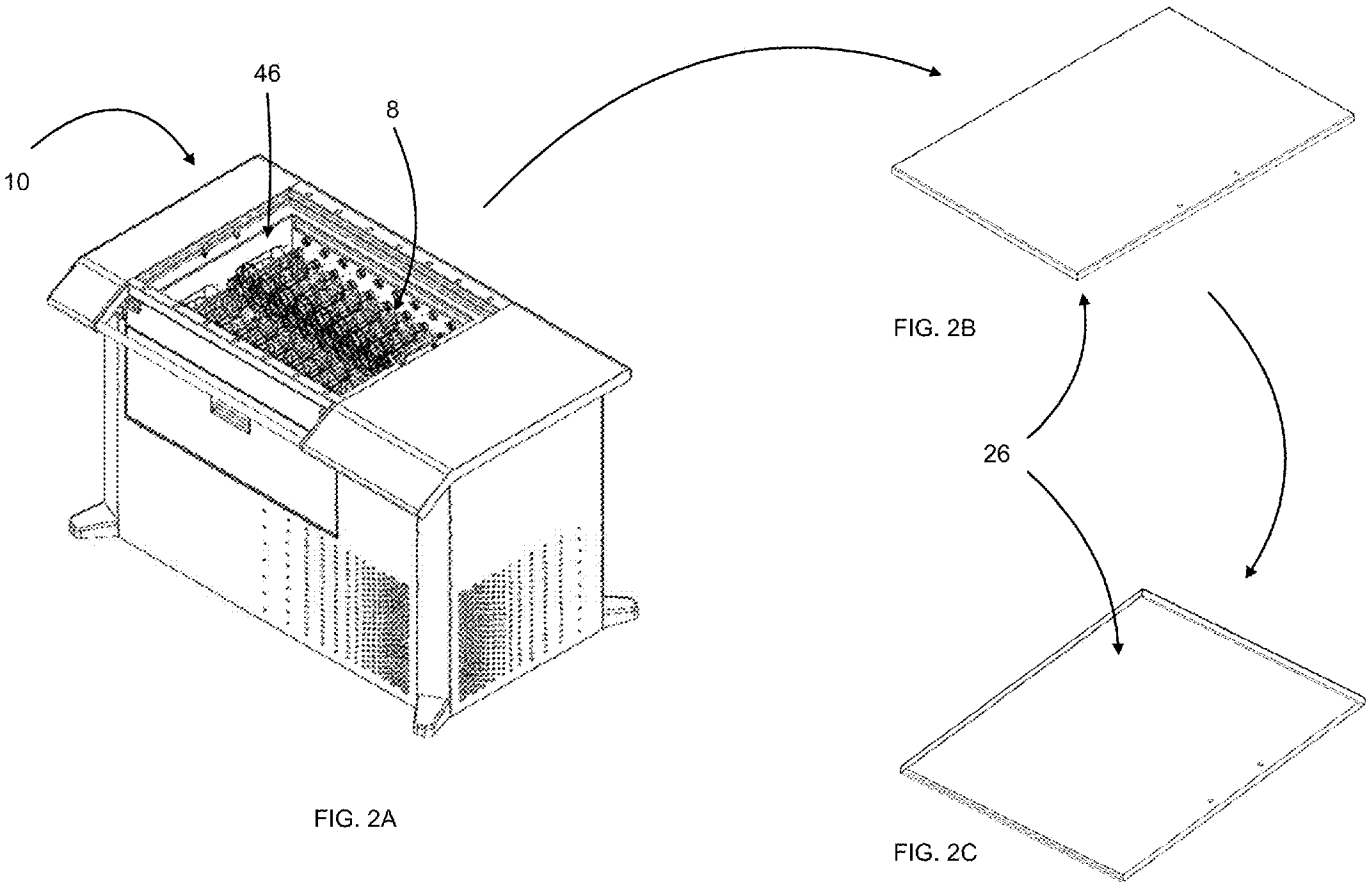
FIGURE 2 Cooler Chest – Isometric View Illustrating top doors removed

FIGURE 3 Top Tray with and without interior components

FIGURE 4 Drawer Inserts With Collapsible Rail

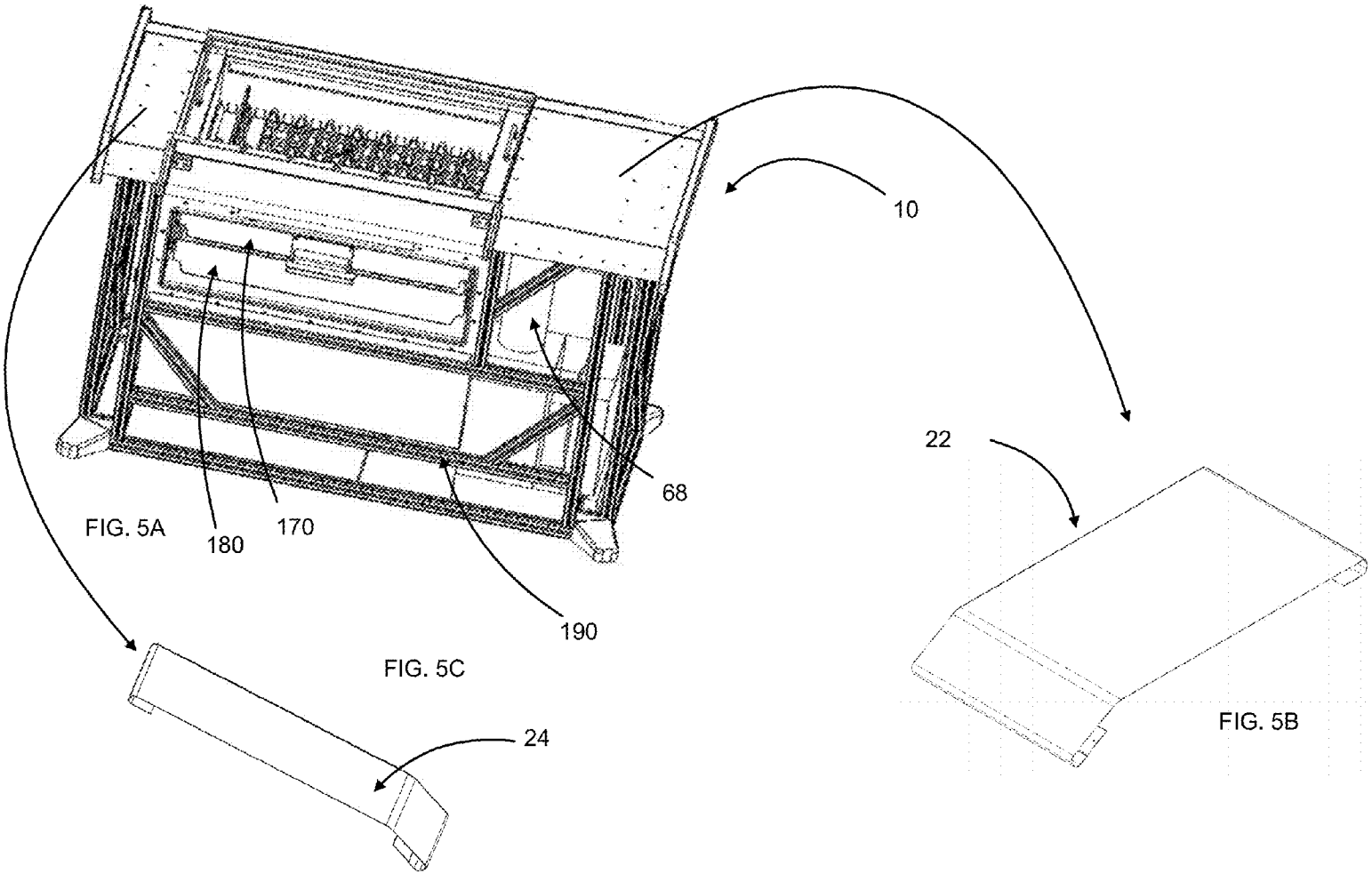
FIGURE 5 Cooler Chest – Illustrating Interior Components and Counter Portions

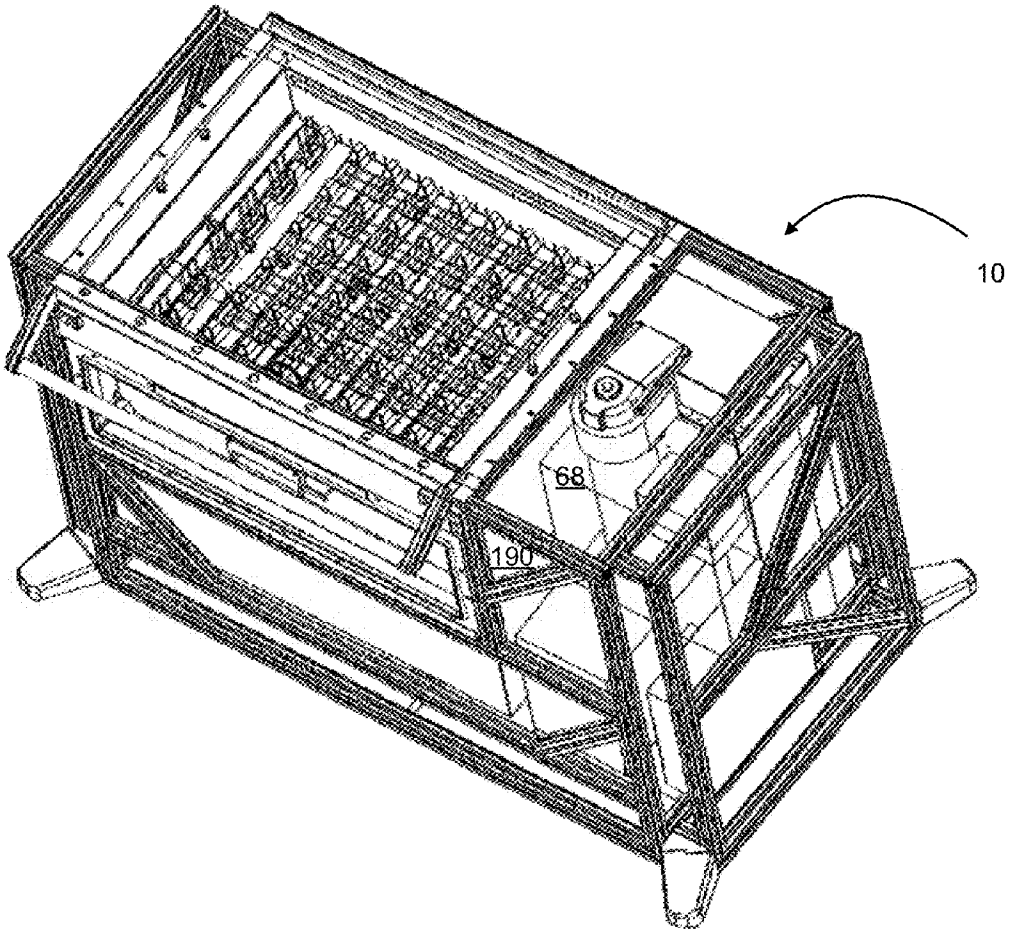
FIGURE 6 Cooler Chest – Illustrating Interior Components

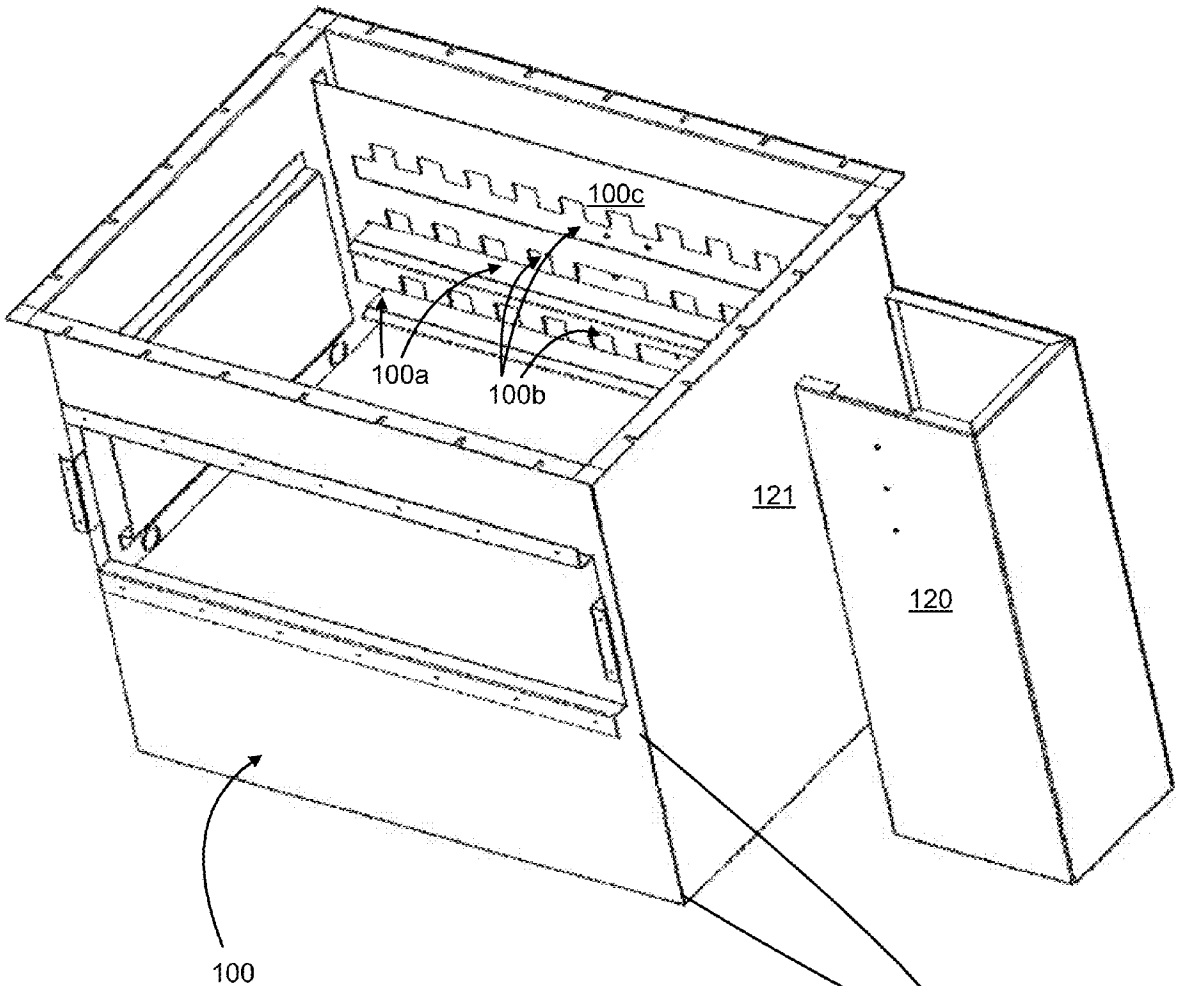
FIGURE 7A Tank – Front Isometric View

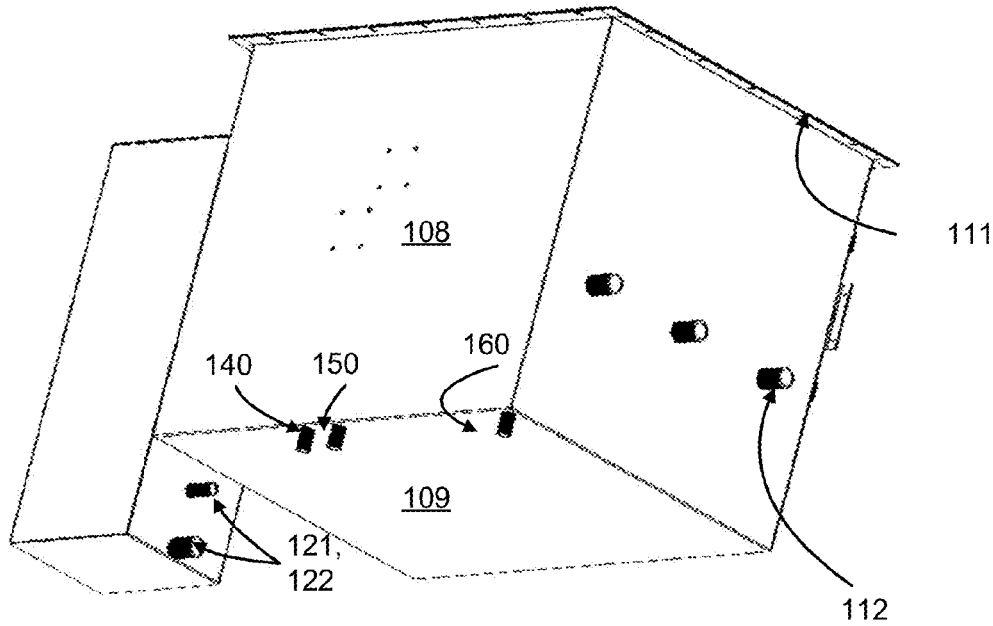
FIGURE 7C Tank – Rear Isometric View
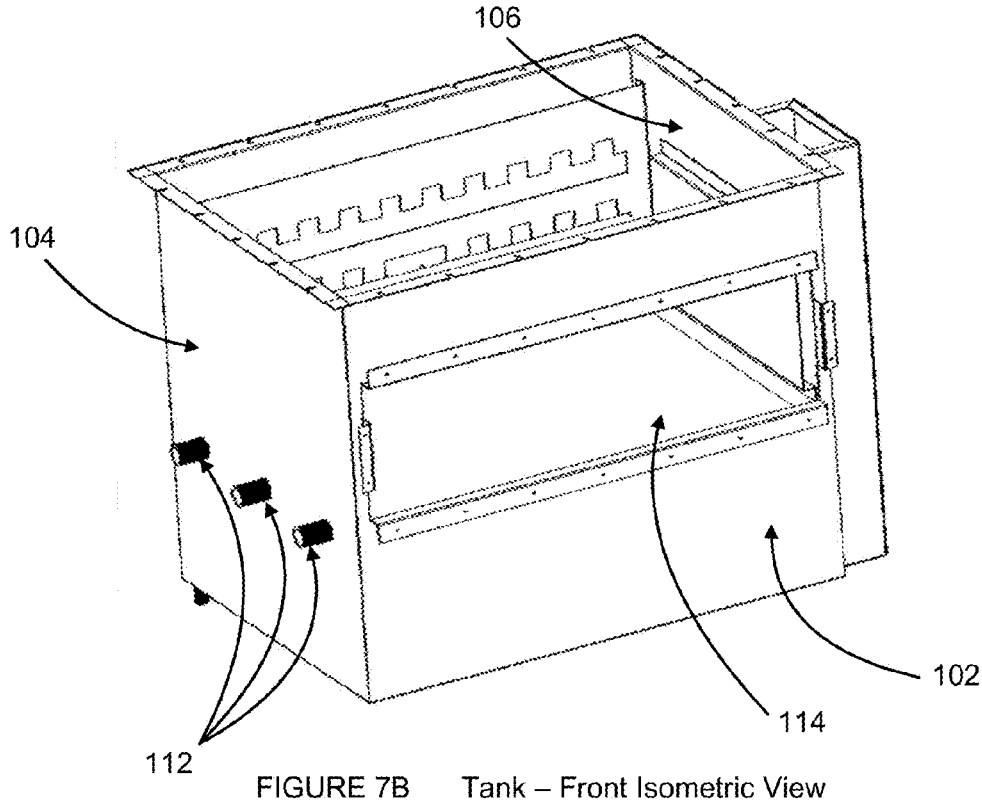
FIGURE 7B Tank – Front Isometric View

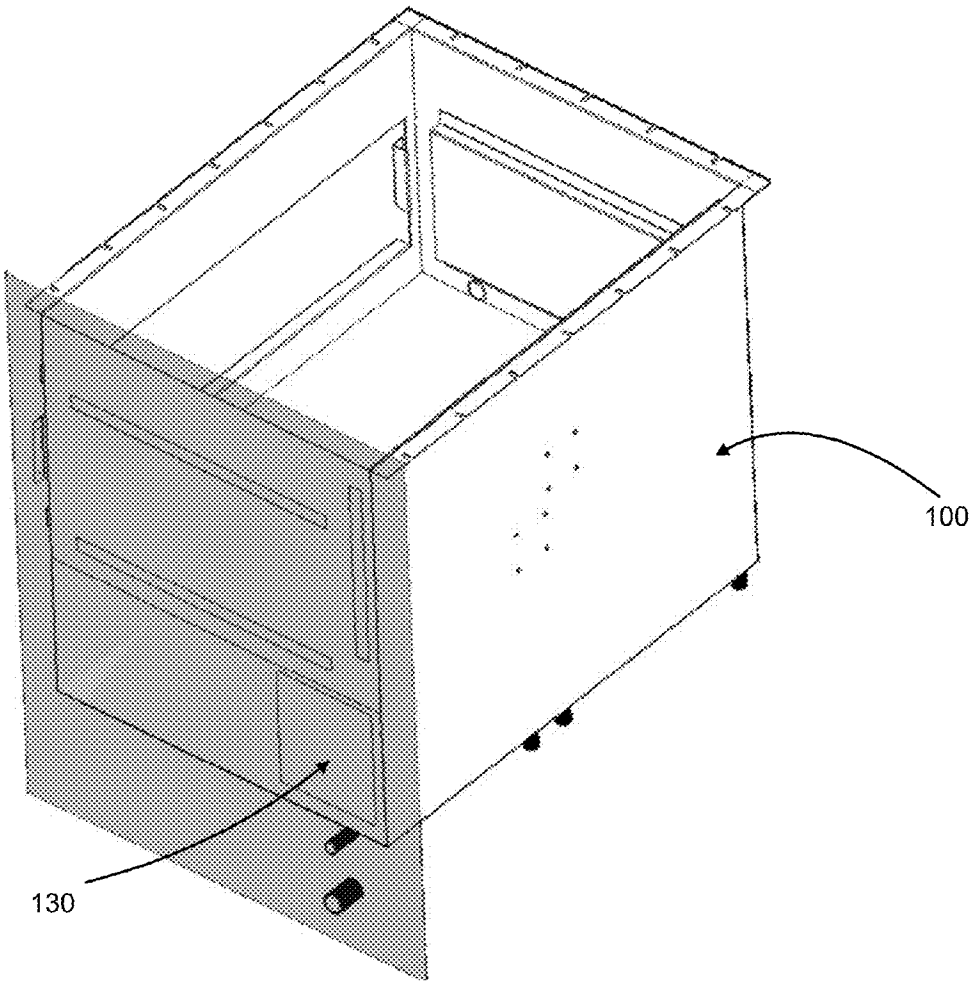
FIGURE 7D Tank – Section Isometric View Illustrating Coolant Passage

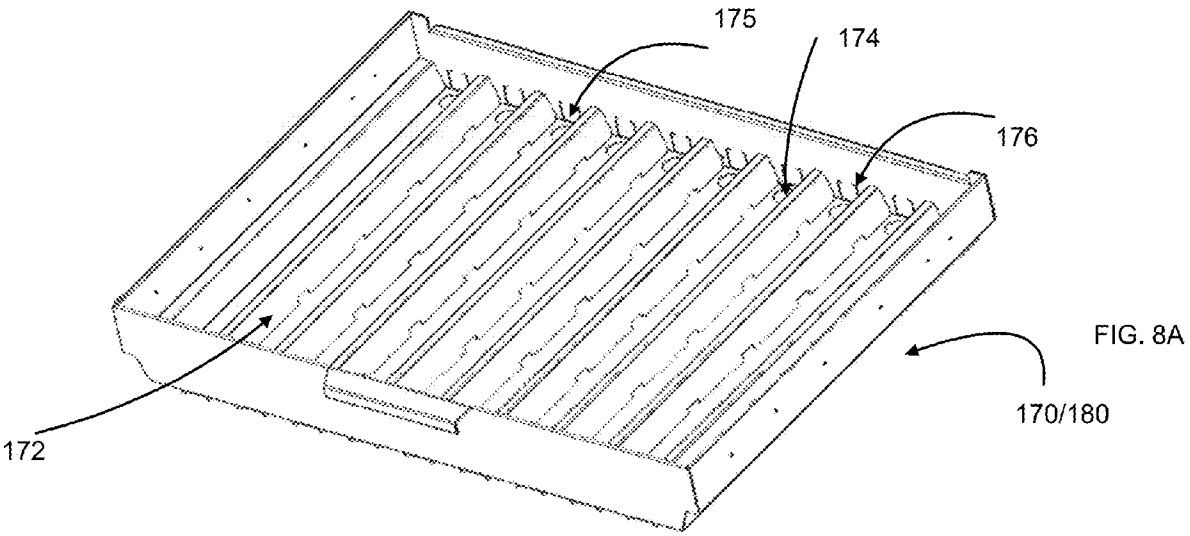
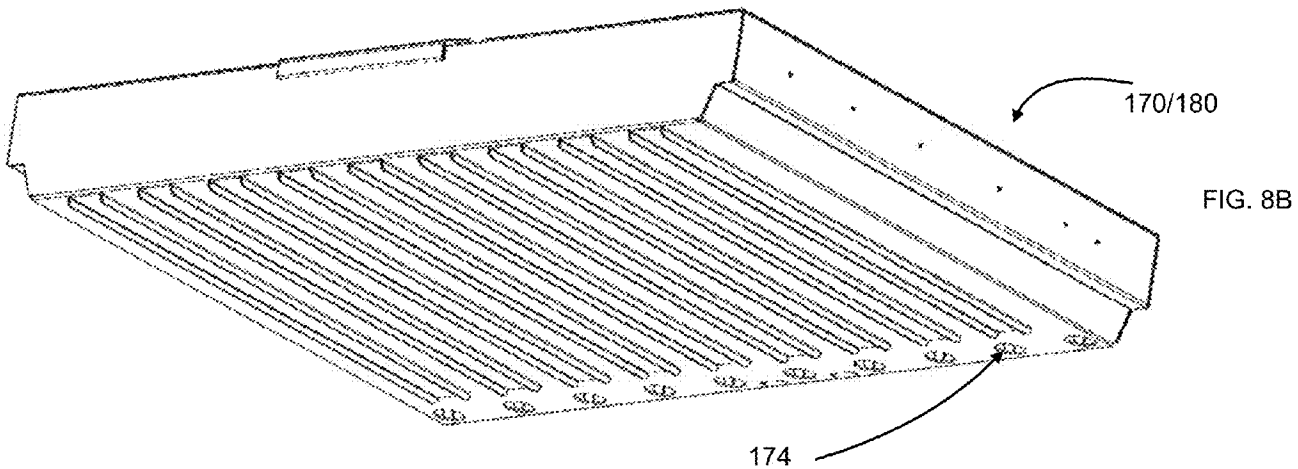
FIGURE 8 Drawers – Top and Bottom Views

FIGURE 9 Icemaker Assembly

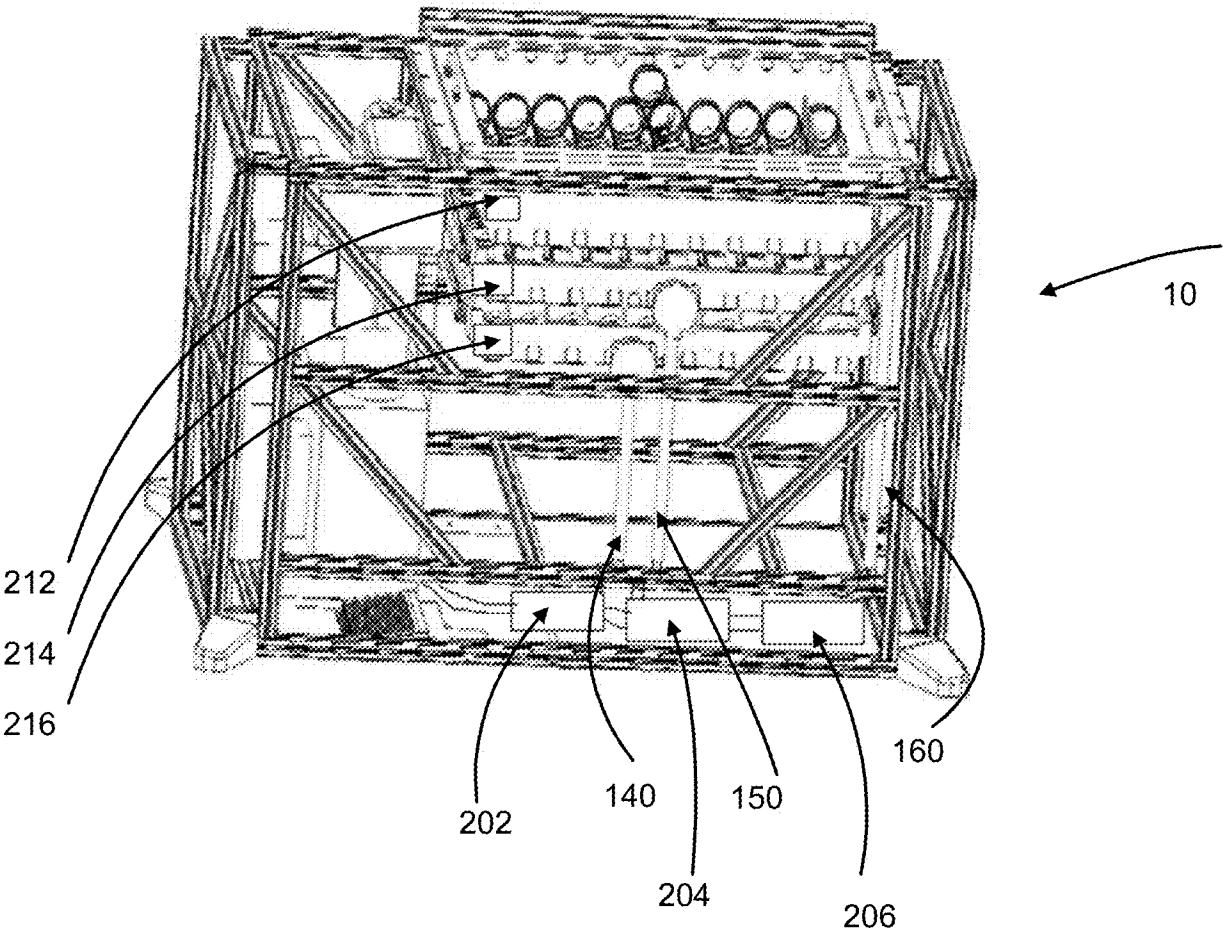
FIGURE 10 Rear View Showing Coolant Flow Conduits and Drawers

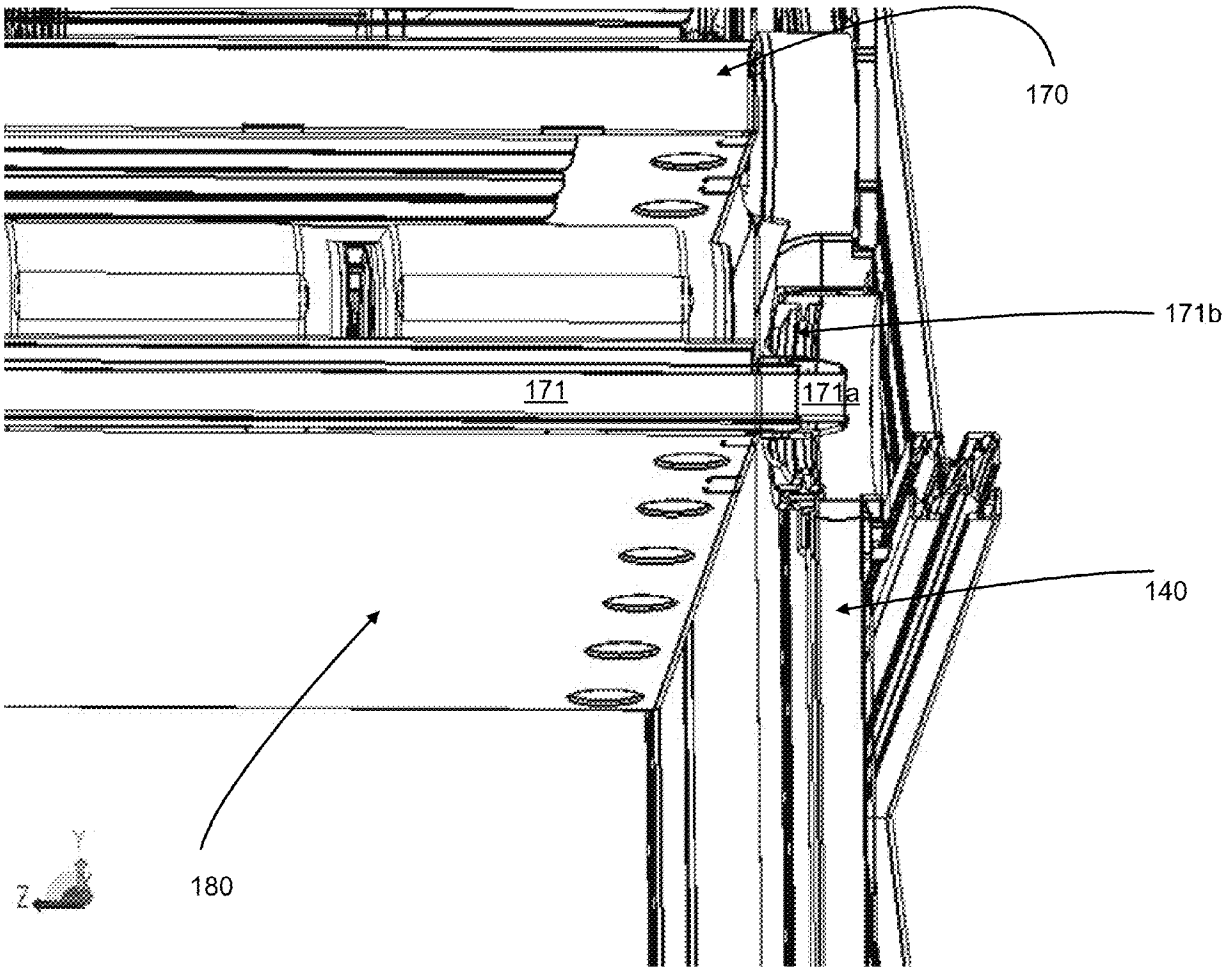
FIGURE 11 Section – Drawer Fluid Connection

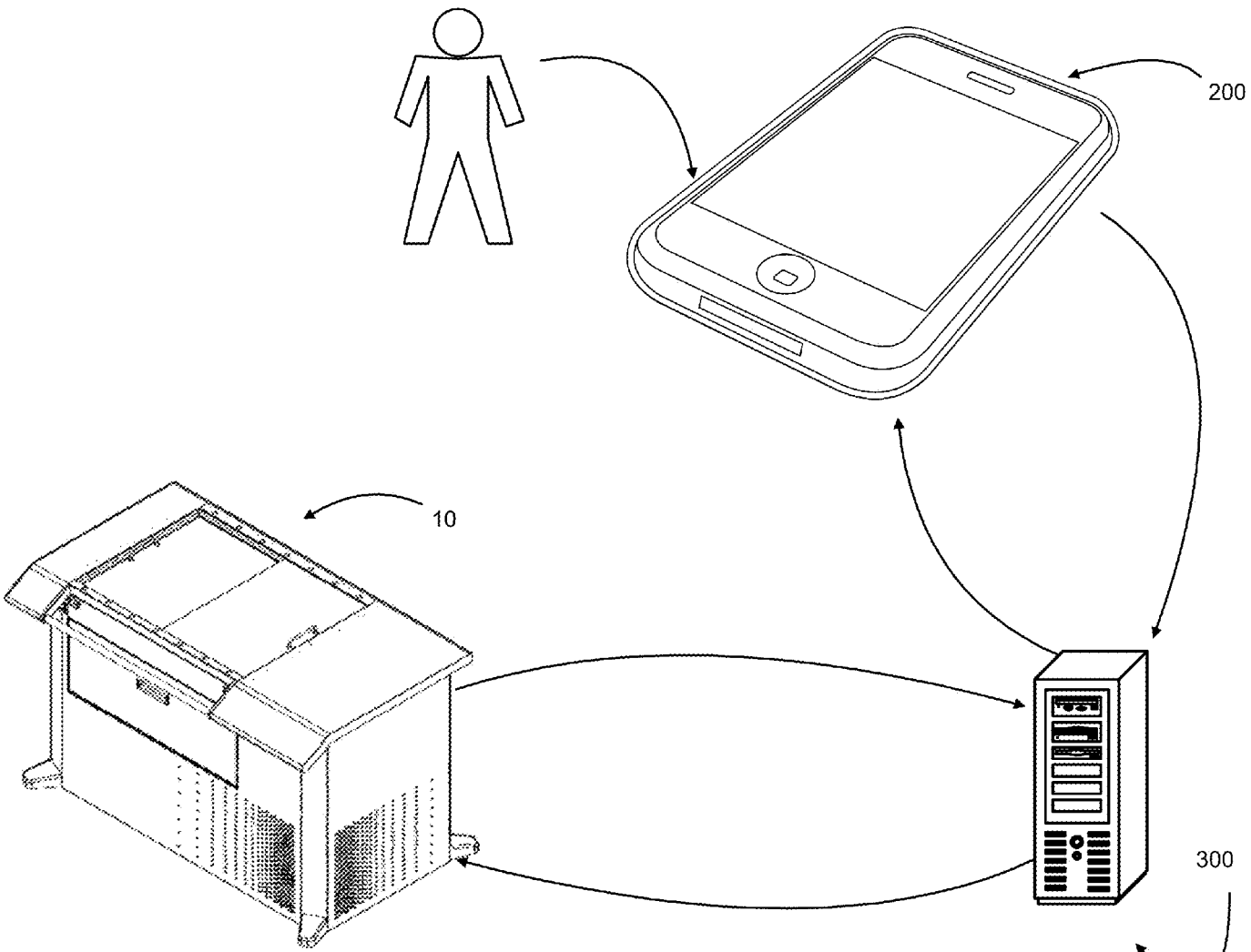
FIGURE 12 Data Flow Diagram

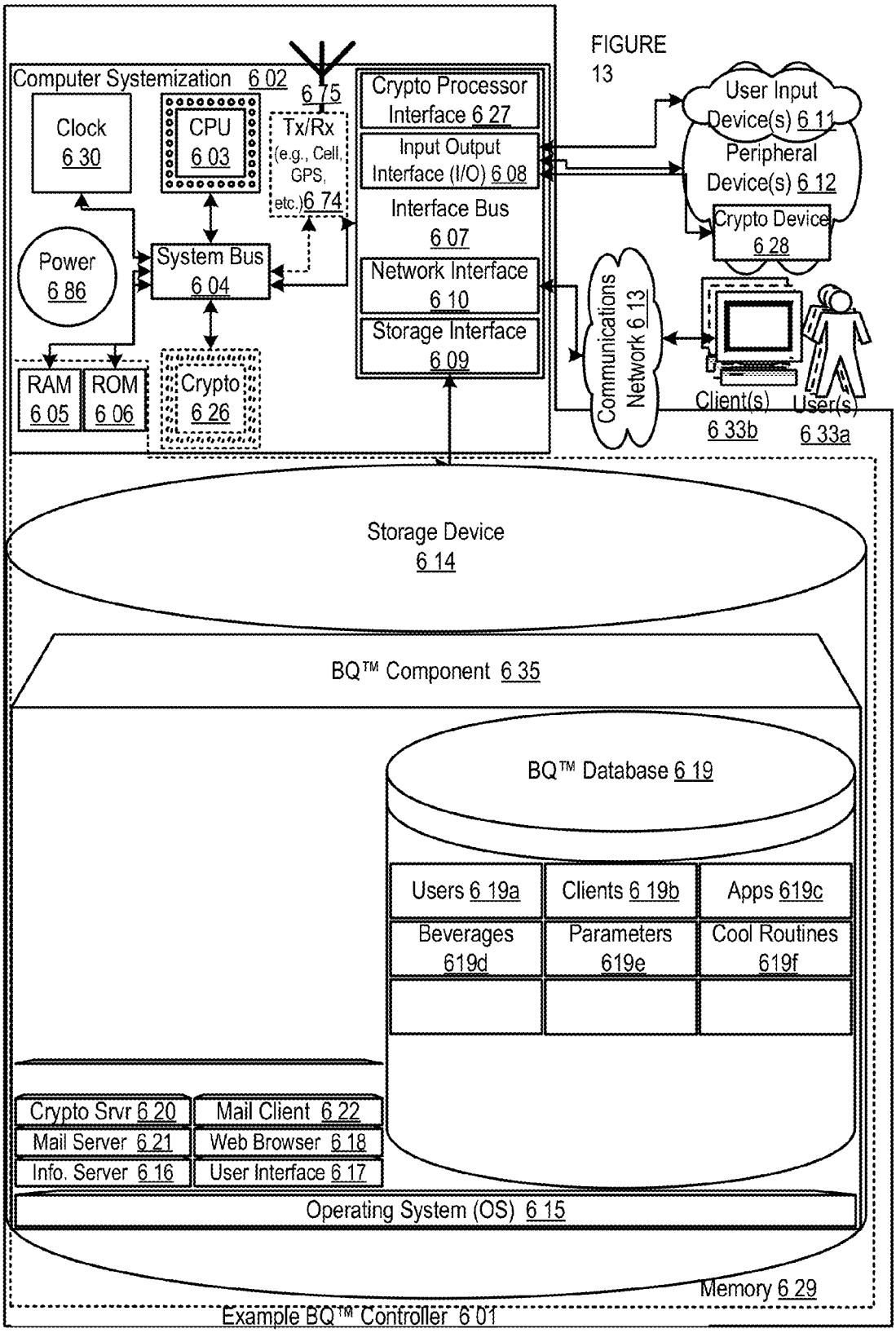
FIGURE 13
Computer Systemization 6 02
Clock 6 30
CPU 6 03
6 75
Tx/Rx (e.g., Cell, GPS, etc.) 6 74
Power 6 86
System Bus 6 04
RAM 6 05
ROM 6 06
Crypto 6 26
Crypto Processor Interface 6 27
Input Output Interface (I/O) 6 08
Interface Bus 6 07
Network Interface 6 10
Storage Interface 6 09
User Input Device(s) 6 11
Peripheral Device(s) 6 12
Crypto Device 6 28
Communications Network 6 13
Client(s) 6 33b
User(s) 6 33a
Storage Device 6 14
BQ™ Component 6 35
BQ™ Database 6 19
Users 6 19a
Clients 6 19b
Apps 619c
Beverages 619d
Parameters 619e
Cool Routines 619f
Crypto Srvr 6 20
Mail Client 6 22
Mail Server 6 21
Web Browser 6 18
Info. Server 6 16
User Interface 6 17
Operating System (OS) 6 15
Memory 6 29
Example BQ™ Controller 6 01

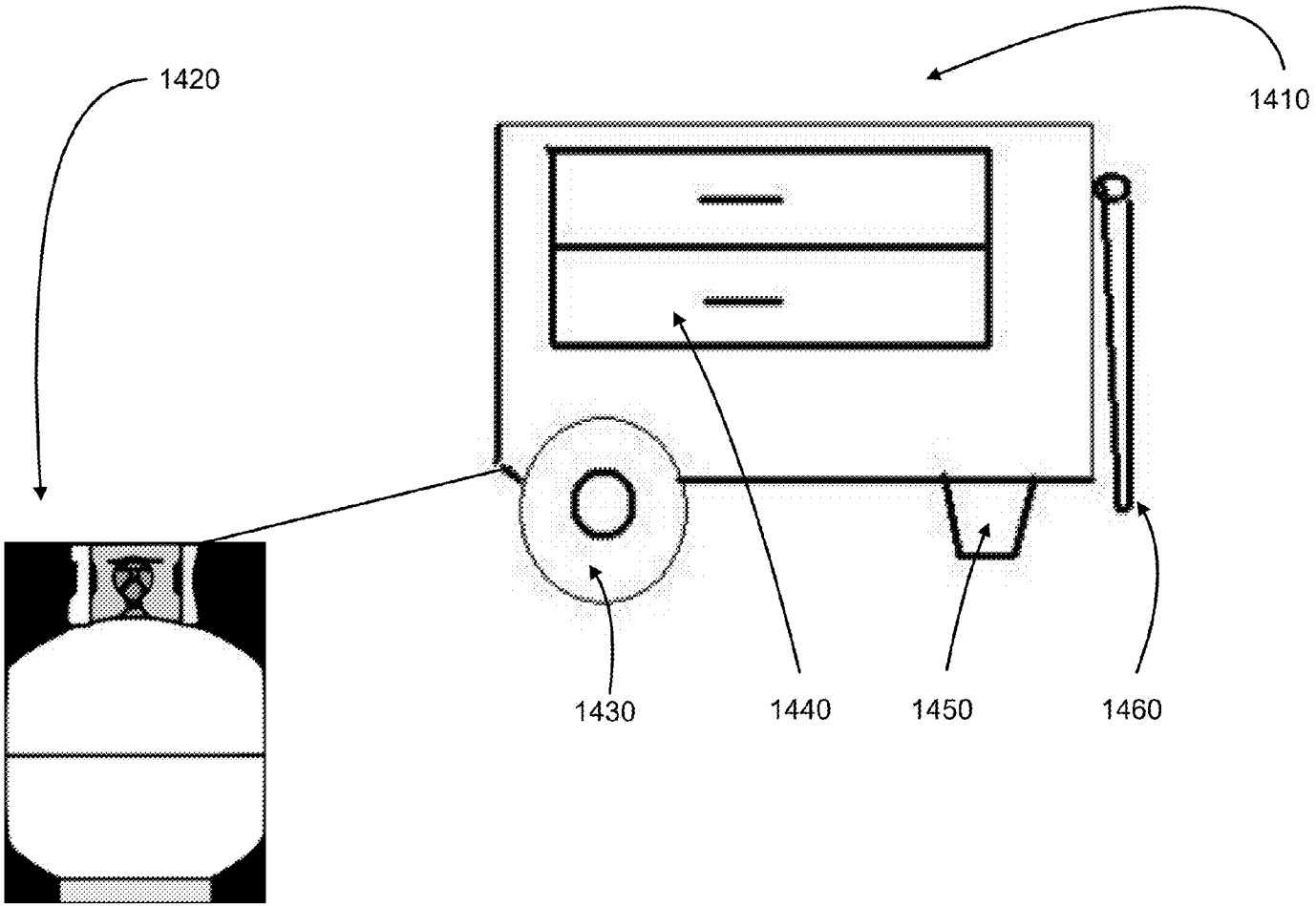
FIGURE 14 Portable Cooling Chest

MULTI TRAY REFRIGERATED CHEST FOR RAPIDLY QUENCHING BEVERAGES

CROSS-REFERENCE TO RELATED APPLICATIONS

This patent application claims the benefit of priority to U.S. Provisional Patent Application Ser. No. 61/798,394, filed Mar. 15, 2013, and U.S. Provisional Patent Application Ser. No. 61/745,033, filed Dec. 21, 2012. The subject matter of the present patent application is also related to U.S. Pat. No. 8,161,769, issued Apr. 24, 2012. U.S. Provisional Patent Application Ser. No. 61/798,394 and U.S. Pat. No. 8,161,769 are incorporated by reference herein in their entireties.

BACKGROUND

1. Field

The present disclosure relates to a refrigerated chest and related methods and machine readable programs for the quenching of beverages or other comestible items, particularly the rapid quenching of beverages to a pre-selected temperature and visual or other notification of when beverages are quenched to a certain temperature (i.e., ready to consume). The present disclosure also relates to mobile applications and other implementations for controlling such devices.

2. Description of Related Art

The use of traditional ice chests for cooling of beverages and maintaining the cooled temperature is well known in the prior art. However, the simple use of ice and water for these purposes has been problematic in that it can take thirty to sixty minutes to cool the beverages and the user has no way of visually determining when the drinks are cooled to the ideal temperature. In short, it has been difficult to determine if the beverages were sufficiently cooled or even over-cooled, and further difficult to maintain the optimum temperature for prolonged periods after the optimum temperature has been achieved. Traditional ice chests have typically not provided the level of elegance and luxury sought by many of today's consumers, particularly those who pride themselves with extravagant outdoor grills and patios.

Moreover, users of ice chests have had to carry their own very heavy ice bags to such chests known in the art and fill those chests with ice. This ice melts to a point where the water becomes warm and turns once cool beverages to warm beverages. The present disclosure provides solutions for this and other problems, as described herein.

SUMMARY OF THE DISCLOSURE

In general, in a first aspect, the disclosure features a chest for quenching beverages, including a tank for holding a chilled mixture of ice and water, an ice maker adapted for making ice having an output for ejecting ice into a conduit in fluid communication with the tank, and a plurality of quench trays disposed above the tank for holding containers of beverages located in first and second positions and which are filled with the cold water by way of a conduit in fluid communication with the tank, the quench trays including a compartment defined by a bottom and a plurality of walls, and defining therein a plurality of rows for aligning and containing a plurality of beverage containers, the drawers further including at least one drain orifice configured to guide water out of the quench tray.

In some implementations, at least one of the quench trays can include a pull out drawer mounted on a track, and the pull out drawer can be adapted and configured to evacuate cooling water contained therein when the drawer is pulled outwardly from a retracted position. If desired, each tray can define a plurality of openings therethrough for guiding water out of the quench tray. At least one of the trays can define the plurality of rows therein by way of a plurality of dividers including raised nodes configured for the placement of a plurality of containers of beverages therebetween. The dividers can include a grate that is configured to be received by a longitudinal groove formed along the base of the divider. The grate can be lifted out of the groove and rotated from an upwardly extending position to a horizontal resting position. In some embodiments, an upper quench tray can be stationary, and a quench tray below the upper tray can be pulled out through the side of the chest. the upper quench tray can be accessible by way of an opening on a top surface of the chest. In accordance with various embodiments, cooling can be effectuated by controlling the flow of chilled water over the beverage containers to enhance the rate of heat transfer to a desired extent.

In accordance with a further aspect, the flow of cold water to each tray can be controlled by the control system in response to temperature data received from the tray. For example, the tray may have one or more temperature sensors in one or more locations. The sensor placement can be indicative of the temperatures of the tray in different locations, and/or individual temperature sensors can be provided to indicate the temperature of the tray proximate each beverage. If desired, the flow of cold water to each tray can be controlled by the control system in response to opening or closing one of the trays. Moreover, if desired, the flow of cold water to each tray can be controlled by the control system in response to data received from the tray indicating that the contents of the tray has changed.

In further exemplary implementations, the chest can further include a control system for controlling the cooling of the chest. The control system can be controlled manually via a control panel mounted on the chest. The control system can be adapted and configured to communicate with a control device over a computer network to facilitate control of the chest. For example, the control device can be a smart phone, among other devices.

Thus, in some implementations, a chest is provided for quenching beverages. The chest includes a tank for holding a chilled mixture of ice and water, an ice maker adapted for making ice having an output for ejecting ice into a conduit in fluid communication with the tank, and a plurality of quench trays disposed above the tank for holding containers of beverages located in first and second positions and which are filled with the cold water by way of a conduit in fluid communication with the tank. The quench trays preferably include a compartment defined by a bottom and a plurality of walls, and define therein a plurality of rows for aligning and containing a plurality of beverage containers. At least one of the trays can further include at least one drain orifice configured to guide water out of the quench tray.

In some implementations, at least one of the quench trays can include a pull out drawer mounted on a track. The pull out drawer can be adapted and configured to evacuate cooling water contained therein when the drawer is pulled outwardly from a retracted position. If desired, each tray can define a plurality of openings therethrough for guiding water out of the quench tray. At least one of the trays can define the plurality of rows therein by way of a plurality of dividers including raised nodes configured for the placement of a plurality of containers of beverages therebetween. At least one of the dividers can include a grate that is configured to be received by a longitudinal groove formed along the base of the divider. The grate can be lifted out of the groove and rotated from an upwardly extending position to a horizontal resting position. An upper quench tray can be stationary in some embodiments, and a quench tray below the upper tray can be pulled out through the side of the chest, if desired. When provided, the upper quench tray can be accessible, for example, by way of an opening on a top surface of the chest.

In some implementations, the chest can further include a control system for controlling the cooling of the chest. The control system can be controlled manually in some implementations via a control panel mounted on the chest. Additionally or alternatively, if desired, the control system can be adapted and configured to communicate with a control device over a computer network to facilitate control of the chest. The control device can be, for example, a smart phone, a tablet, a stationary panel mounted in a fixture or wall, a wristwatch, a remote computer, and the like.

In some embodiments, the flow of cold water to each tray can be controlled by the control system in response to temperature data received from the tray. If desired, the flow of cold water to each tray can be controlled by the control system in response to opening or closing one of the trays. Moreover, the flow of cold water to each tray can be controlled by the control system in response to data received from the tray indicating that the contents of the tray has changed. In some implementations, at least one of the quench trays can include a plurality of temperature sensors in different locations across the tray. The temperature sensors can be configured to provide temperature data to the controller. The controller can be configured to adjust the amount of cooling water directed to each tray in response to temperature data received from the temperature sensors. In some embodiments, sufficient sensors can be provided in the tray to indicate the temperature of the tray proximate each beverage.

In accordance with further aspects, cooling of beverages in the chest can be effectuated by directing a flow of chilled water over the beverage containers. If desired, the flow of cooling water can cause the beverage containers to rotate in place to enhance heat transfer from the beverage containers to the cooling water.

In still further implementations, the quench tray drawer can be disconnected from its source of cooling water when it is pulled out. The source of cooling water for the quench tray drawer can include a fitment proximate the back of the drawer that is received by a cooling water supply line when the drawer is closed. The supply of cooling water to the drawer can be deactivated when the drawer is pulled out. The supply of cooling water can be deactivated, for example, by turning off a pump and/or by closing or adjusting a valve.

The above advantages and features are of representative embodiments only, and are presented only to assist in understanding the disclosure. It should be understood that these are not to be considered limitations on the disclosure as defined by the claims. Additional features and advantages of embodiments of the disclosure will become apparent in the following description, from the drawings, and from the claims.

DESCRIPTION OF THE DRAWINGS

Further objects and advantages of the disclosure will become apparent from the following description and from the accompanying drawings, wherein:

FIGS. 2A-2C is a perspective view of the cooling chest of an embodiment of the present disclosure, shown with the top access doors removed, as well as illustrating upper and lower views of the top access doors.

FIGS. 5A-5C illustrate the cooling chest of FIG. 1 with side panels removed, revealing inner components of the cooling chest, as well as top countertop components of the cooling chest.

FIG. 6 is an isometric view of the cooling chest of FIG. 1 with all external paneling removed to illustrate interior portions of the cooling chest.

FIGS. 7A-7D are isometric views of an inner tank portion of the cooling chest of FIG. 1.

FIGS. 8A-8B are views of an exemplary displaceable drawer for use within the cooling chest of FIG. 1, illustrating tray dividers and openings for guiding cooling water.

FIG. 10 is a rear view of the cooling chest of FIG. 1, illustrating cooling water delivery tubes that feed into and cool the trays of the cooling chest.

FIG. 11 is a cross-sectional view of the drawer of FIG. 8, showing details of a fluid connector to direct cooling water into the drawer.

FIG. 12 is a data flow diagram illustrating a system for controlling a cooling chest by way of a remote or mobile device in accordance with the present disclosure.

FIG. 13 is a schematic view illustrating aspects of an exemplary system in accordance with the present disclosure.

FIG. 14 is a schematic view illustrating a portable embodiment of a cooling chest in accordance with the disclosure.

DETAILED DESCRIPTION OF THE PREFERRED EMBODIMENTS

Figure 1B:
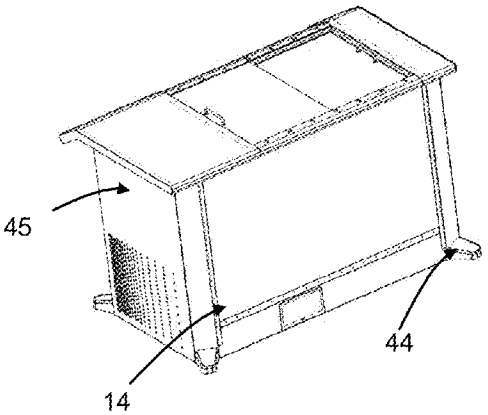
FIGS. 1A-1C are perspective views of an illustrative embodiment of a cooling chest in accordance with the present disclosure, shown with top and side access doors closed.
Figure 1C:
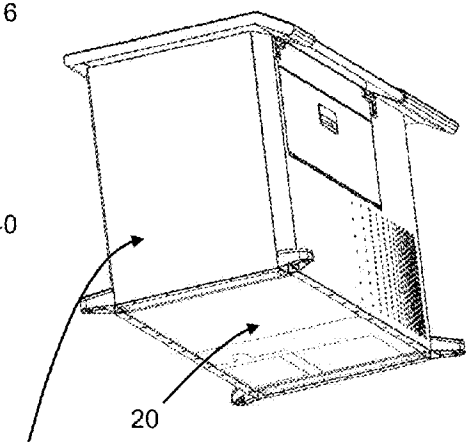
Figure 1A:
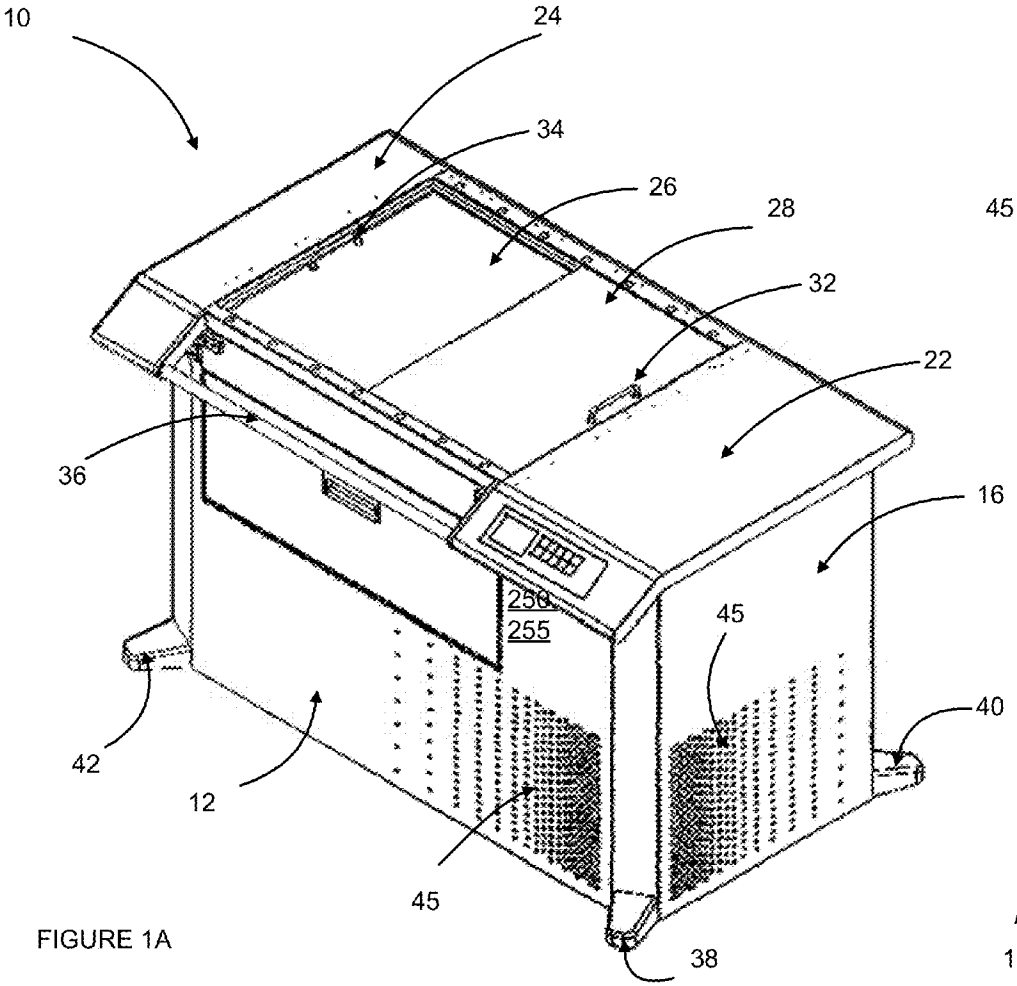

Referring now to the drawings in detail wherein like numerals indicate like elements throughout the several view, one sees from the various drawings that the cooling chest to includes a front wall 12, a rear wall 14, side walls 16, 18 and a bottom wall, 20, all in relatively fixed locations thereby forming an interior cooling volume 8. The cooling chest to also includes a right side counter 22 (as shown in FIGS. 2B, 2C and 5B) and a left side counter 24 on the top surface of the cooling chest to (as shown in FIGS. 1A and 5C). The top surface of the chest also includes dual top lids or access doors, 26, 28 which can be in the closed position as shown in FIG. 1 or in an open position wherein one door slides along the top or bottom of the other, respectively. The perimeter of the opening containing the doors includes a suitable gasket to prevent heat inflow. Similarly, a generally linear gasket is located along an edge of one of the doors 26, 28 for abutting against an edge of the other door, thus providing a cooling gasket at the junction of the two doors 26, 28 when the chest is closed.

The dual top lids or access doors, 26, 28 each includes its own handle 32, 34 which allow for the access doors to be lifted up and/or slid, as desired so that the doors can overlap. In one embodiment, the doors can be hinged at the sides and opened from center mounted handles. In another embodiment, the handles, 32, 34 can be used to slide each access door 26, 28 on corresponding tracks (not shown) located on the interior of the lateral edges of the rear wall 14. Preferably, a linear gasket is used at the edge of one of the doors 26, 28 to provide sealing against the adjacent door when the doors are closed, and a perimeter seal is provided around the opening in which the doors are situated in order to reduce heat transfer in that location.

A handle 36 connects the right side counter 22 and the left side counter 24 of the cooling chest 10. If desired, handle 36 can merely serve the function of providing a means to move the cooling chest 10. In another embodiment, the entire top assembly of cooling chest 10 can be hinged at the back of the top of the cooling chest, and the handle can be lifted to access beverages and to examine and maintain the interior portion of the cooling chest. The front wall 12 as illustrated in FIG. 1 contains a front access door 30 with a latch 36 which when pulled, can be opened downward. As illustrated, the bottom wall 20 of the cooling chest 10 includes protrusions or legs, 38, 40, 42, 44 that extend from each corner, and that may include castors or wheels, as desired (not shown). Legs 38, 40, 42, 44 act to enhance stability of the cooling chest 10 (such as during movement and transport), and also act to prevent the cooling chest 10 from being moved too closely to a wall to permit ventilation clearance for the cooling chest 10. Ventilation perforation sections 45 or screening, as desired, are provided in each side panel to permit air circulation to facilitate cooling of the icemaker and the refrigeration process. As illustrated, perforation sections 45 include perforations in a pattern of varying density from left to right. It will be appreciated though that any suitable types of perforations, louvers, screens or the like are suitable.

The walls 12-20 and access doors 26-30 can be formed from a variety of materials, such as aluminum, stainless steel, painted sheet metal, injection molded plastic or composite materials, fiber reinforced resin materials and the like in order to provide a sleek, elegant appearance, while maintaining the desired temperature insulating capabilities. Those skilled in the art will recognize that these materials are merely illustrative and not intended to be exhaustive.

As further shown in FIG. 2A, the cooling chest 10 may contain a plurality of beverage containers in its interior cooling volume 8. In FIG. 2, beverage containers are neatly packed and located in the upper quench tray 46 and may be similarly situated in two lower trays, as illustrated and as discussed in further detail below. Such beverage containers can be accessible by the opening or removal of the dual top lids or access doors, 26, 28. Likewise, beverage containers can be loaded into the upper quench tray 46 when the dual top lids or access doors, 26, 28 are slid open or removed as is illustrated in FIG. 2. FIG. 2B illustrates the top view of the dual top lids or access doors 26, 28. FIG. 2*c* illustrates the bottom view of the dual top lids or access doors 26, 28.

As illustrated in FIG. 3, the upper quench tray 46 includes an empty rectangular bin 48 with a hollow interior designed to hold a generous quantity of beverage containers. The bottom surface 50 of the upper quench tray 46 can include a plurality of pairs of rows that in turn include pairs of openings 64 which allow for tray dividers 52 to be attached to the upper quench tray 46. Each row culminates into openings 54 defined by a parametric slit located on the rear interior wall 6 of the upper quench tray 46 which allows for water be guided out of the quench tray. The upper quench tray 46 can be made from a plastic, metal and/or composite materials, as desired.

Figures 3A, 3B:
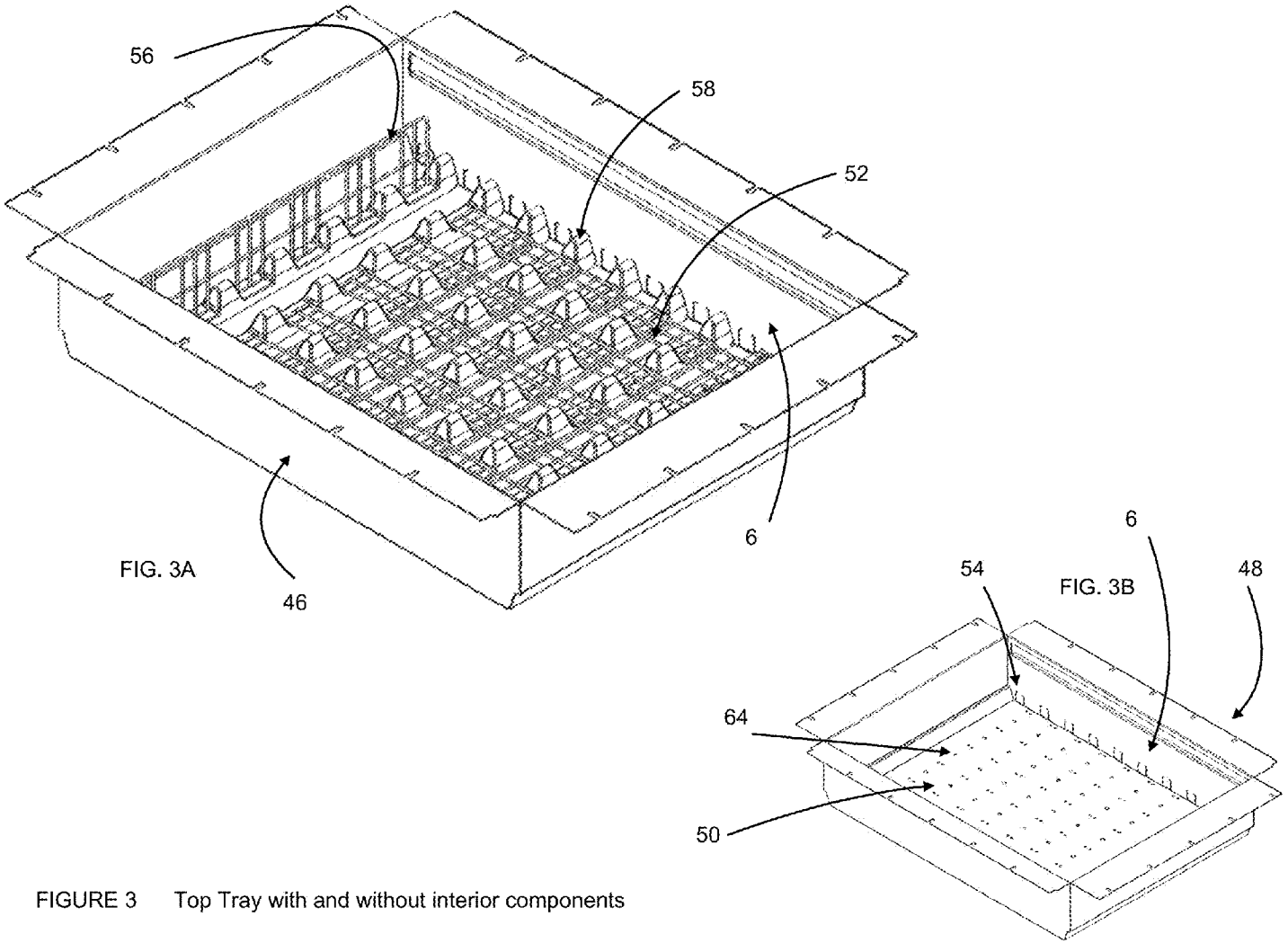
FIGS. 3A-3B include perspective views of a top tray of the cooling chest of FIG. 1 illustrating aspects of beverage separators in the top tray and the top tray with the aforementioned structures removed.

FIG. 3A shows the upper quench tray 46 fitted with a plurality of tray dividers 52, which are further illustrated in FIGS. 4A-4D. Each tray divider 52 can be provided with an adjustable grate 56 that may be disposed in an upright position is shown, or lifted slightly and rotated and dropped to one side, if desired, to make room for larger beverage containers. Beverage containers loaded into the upper quench tray 46 are laid against the grate 56 when the grate 56 is in the upright position as shown in FIG. 3A. The grate 56 in the upright position as shown in FIG. 3A allows for the beverage containers to also be removed from the cooling chest 10. The design of the grate 56 allows for the fitting of the grate 56 in between the raised nodes 58 of the tray dividers 52. The fitting of the grate 56 allows for the adjustability and raising of the grate 56 from a flat position to an upright position. As the upper quench tray 46 is continuously filled with cooling water by the cooling chest (as discussed below), the beverage containers are allowed to lie flat and ultimately submerged in the cooling water of the upper quench tray 46. The grates 56 can be made from plastic, metal and/or composite materials, as desired.

Figure 4C:
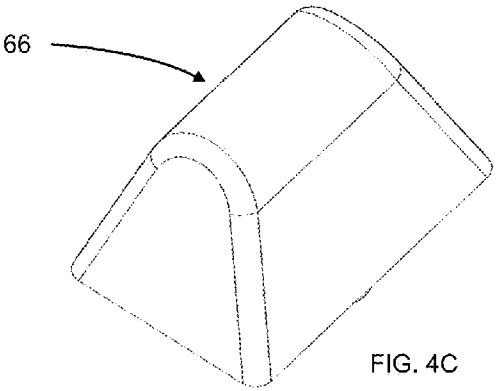
FIGS. 4A-4D illustrate views of aspects of a tray divider in accordance with the present disclosure.
Figure 4D:
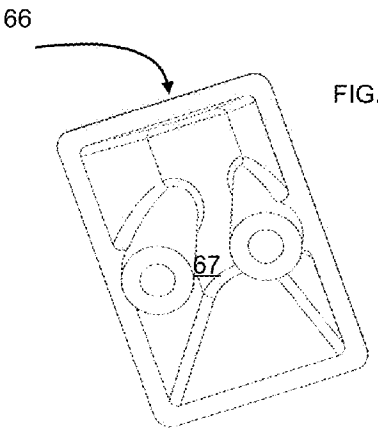
Figure 4A:
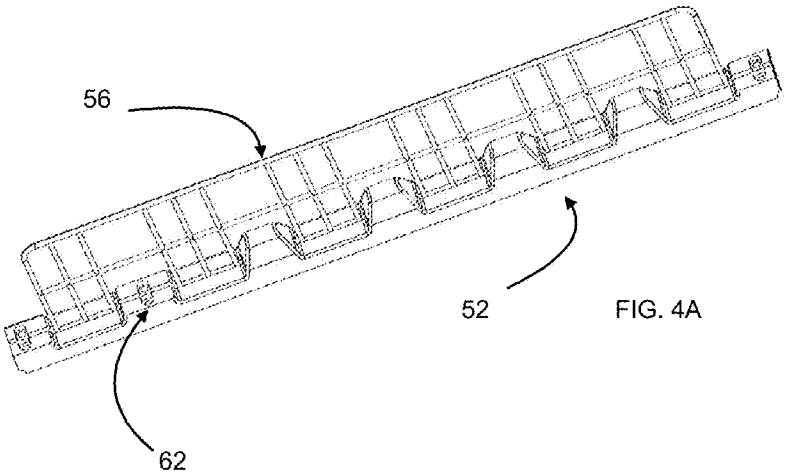
Figure 4B:
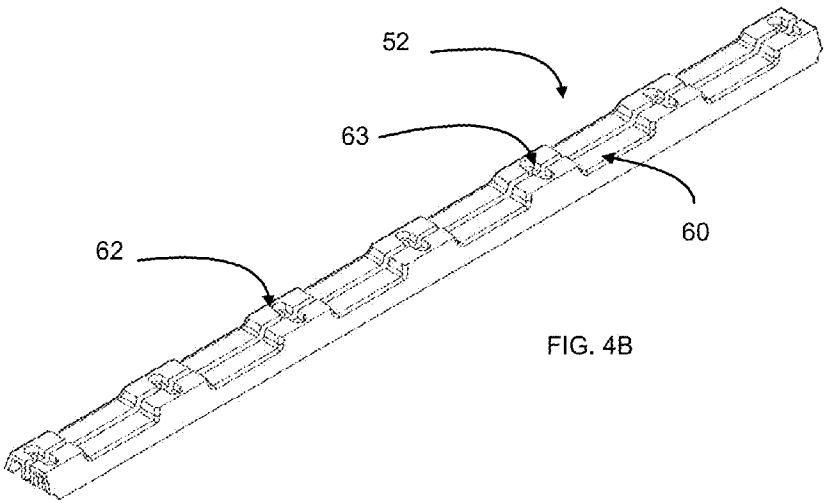
Figure 9B:
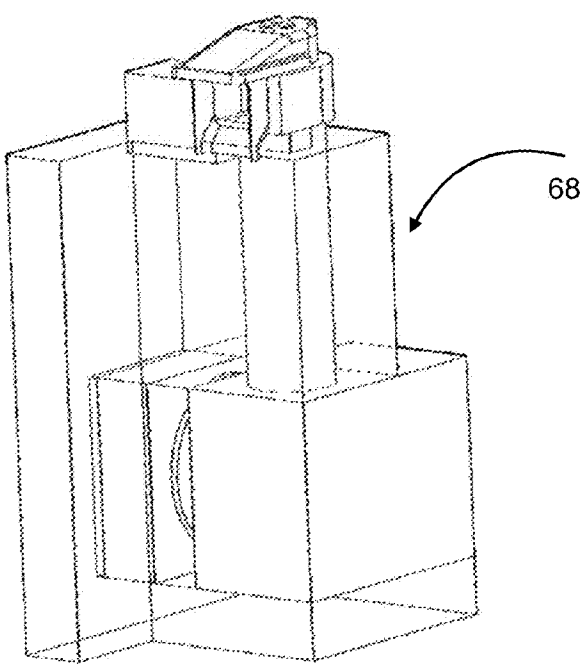
FIGS. 9A-9B are isometric views of an icemaker assembly component of the cooling chest of FIG. 1.
Figure 9A:
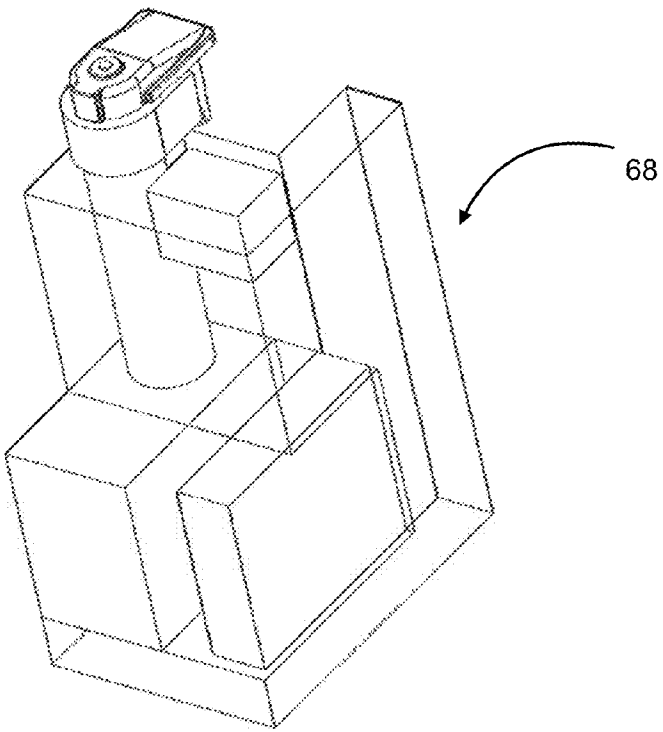

As mentioned above, FIGS. 4A-4D illustrate a single tray divider 52, or components thereof before it is fitted into the upper quench tray 46. Tray dividers contain a linear center groove 60 spanning the length of the tray divider 52. The groove 60 is designed to receive the grate 56 in a generally vertical orientation. Tray dividers 52 also contain a plurality of raised divider portions, or bosses, 62 which contain a pair of recesses 63 on either side of center groove 60 that correspond to pair of bosses 67 located on the bottom surface of the raised nodes 66. FIG. 4B illustrates a bottom rail portion of the tray divider 52. FIGS. 4C-4D illustrate upper and lower views of the raised nodes 66 which attach to the lower portion of the tray divider 52 via bosses 67 in the bottom of the nodes interfitting with recesses 63 such as by interference fit, adhesive or welding, for example. The raised nodes help retain the grate 56 in place and to permit rotation of the grate 56 to permit the grate 56 to be rotated and pulled up into its upright position as well as flat position. Tray dividers 52 and the raised nodes 66 can be made from plastic, metal and/or composite materials, as desired.

FIG. 5A illustrates the cooling chest to with all of it side panels removed exposing, for example, pull out drawers 170, 180 and ice maker assembly 68. FIG. 6 illustrates the cooling chest and its interior components. The interior of the cooling chest, as illustrated, includes a chassis 190 for housing various components not shown including pipes, pumps and/or tubes for the delivery cold water from the tank too (as illustrated in FIGS. 7A-7D) to each of the three illustrated quench trays discussed elsewhere herein. Chassis 190 also provides a support for the exterior paneling of the cooling chest. While a particular chassis 190 is illustrated, it will be appreciated by those of skill in the art that a variety of structures can be used in place of chassis 190. For example, a stamped metal or blow molded composite chassis 190 can be provided for housing system components as typically with appliances.

As illustrated in FIGS. 7A-7D the tank too is generally rectangular in shape, and includes a front wall 102, a left wall 104, a right wall 106, a back wall 108 and a bottom 109, which cooperate in part to define a lower tank portion 110 extending from the bottom 108 of the tank to three water conduits 112 on the left side of the tank too as illustrated in FIG. 7B. Tank too defines an upper peripheral flange 111 at its upper extremity at the top of each of the front, back, left and right walls, and thus defines a horizontally oriented rectangular opening at the top of the tank. As illustrated, upper peripheral flange in of tank 100 is adapted and configured to rest on crossmembers forming the chassis 190.

Tank 100 contains therein a backing plate 100*c* including two horizontally oriented flanges or shelves 100*a* and a plurality of openings 100*b* of different shapes and sizes. The backing plate 100*c* acts as a rear stop for drawers 170, 180, and each shelf 100*a* is adapted to snugly fit with the rear lower surface of each drawer 170, 180.

The front wall 102 of tank 100 similarly defines a generally rectangular opening 114 in the front thereof for permitting the passage of two pull-out quench drawers 170, 180 therethrough. As illustrated in FIG. 7A, the right side of tank 100 includes an extension 120 having a J-shaped cross section (taken in a horizontal plane) defining an elongate vertical gap 121 between an edge of the extension 120 and the right wall 106 of the tank 100 for receiving and mating with the ice maker 68, discussed below. Tank further defines a rectangular opening 130 in its right side for aligning with the icemaker assembly 68 as illustrated in FIG. 7D.

In accordance with one aspect of the present disclosure, the cooling chest 10 includes an ice maker assembly 68 that allows for the continuous production of ice which in turn allows for the continuous production and flow of cold water over the ice situated in the vertical hopper 68*a*, discussed in detail below. A suitable icemaker assembly should be able to produce between about 10 and 100 pounds of ice per hour, for example. The ice maker is adapted to interfit with the J-shaped extension 120 on the tank 100 to define a vertical hopper 68*a* with a generally rectangular cross section for receiving ice made by the ice maker.

The continuous flow of cold water over the ice in the hopper 68*a* allows for the continuous cooling of beverage containers located in the plurality of quenching trays. The continuous flow may be interrupted at any point by turning off pump(s) (not shown) located underneath the tank 100 and above the bottom of the cooler 10 that are used to circulate cooling water through the cooler. Turning off the pumps can be achieved manually through a switch, such as by a switch that is activated when a drawer is pulled out, or when one of the top doors 26, 28 is opened.

The ice maker 68 is adapted to make ice, filling up the hopper 68*a* until reaching an upper limit switch (not shown). The limit switch can be a mechanical arm and switch as known in the art that deactivates the ice maker 68 when a predetermined ice level is reached, or may alternatively include an electric eye that deactivates the ice maker when the desired level is reached. The bottom of the hopper 68*a* is in fluid communication with the bottom of the tank by way of rectangular opening 130 in the bottom of the tank too. Water in the bottom of the tank 100 can flow into the bottom of the hopper 68*a* and is cooled by the column of ice. Ice can similarly migrate into the lower portion 110 of tank by way of opening 130, if desired. Water can be circulated, for example, by directing cold water out of one of the conduits 121, 122 at the bottom of the hopper 68*a*, through one or more pumps (not shown), and up into conduits 140, 150, 160 for feeding the lower, middle, and upper trays of the cooler, respectively and/or back into the tank too by way of conduits 112 on the left side 104 of the tank too. Conduits 112 can similarly be used to regulate the level of water in tank 100 by causing overflow that reaches the conduits to be directed to a drain and/or reservoir, as desired.

Top and bottom views of the middle and lower quench trays or drawers 170, 180 are illustrated in FIG. 8. The drawers can be essentially identical or may differ as desired. Each drawer 170, 180 can have dividers similar to the upper quench tray 46 with collapsible gratings, as desired. As illustrated, longitudinal dividers 172 run from the back of the drawer to the front of the drawer inside of the drawer, and longitudinally oriented C-channels are attached to the bottom of the drawers for additional support. A conduit 171 can be provided within one of the dividers 172 (as illustrated in FIG. 11) for directing cooling water from an input at the back of the drawer up to the front of the drawer. Alternatively, water may simply enter the drawer from the back of the drawer. The cooling water thus can be directed into the front of the drawer and flow backward over the beverage containers. The rate of cooling can thus be controlled by controlling the flow of chilled water over the beverage containers to enhance the rate of heat transfer to a desired extent. It will be appreciated by those of skill in the art that directing a flow of cold water over the beverage containers will cause greater heat transfer than merely submerging beverages in cold water. It will be further appreciated that the level of water in each quench tray can be controlled by adjusting the volume flow rate of water into the drawer as well as the size of the drain orifice or orifices in the drawer. In some embodiments, cooling water is directed through the drawer at a level that does not cause the beverage containers to move. In such an embodiment, the heat transfer from the beverages to the cooling water is driven principally by the temperature differential between the beverage container and the cooling water, as well as the material from which the beverage container is made. In other implementations, the cooling water is permitted to rise to a level to permit the beverage containers to float slightly and rotate in place. In such implementations, the rate of heat transfer can be enhanced as a result of a larger surface area of the container being contacted by water, as well as the fluid within the container mixing while it is rotating causing the fluid in the container to come down to temperature more quickly. In some instances, where the containers are oriented perpendicularly with respect to the flow, this effect can be enhanced. If desired, each drawer can be slanted from front to back to facilitate the flow of water toward the back of each drawer. Drawers 170, 180 also can each include a handle that is integral, as illustrated, or that may be separately attached. In the illustrated embodiment, drawers 170, 180 are made from sheet metal and the handles are integrally formed with the drawers.

Each drawer, as illustrated, includes dump orifices 174 along the rear portion of the bottom of the drawer that are positioned over horizontal flanges 100*a* on the bottom of the tank 100 when the drawer is pushed in. Similarly, tabs 175 defined by perimetric grooves 176 are disposed in the back face of each drawer, which can be aligned with or staggered with openings 100*b* in backing plate 100*c*. Both dump orifices 174 and grooves 176 are intended to facilitate rapid evacuation of water from either drawer 170, 180 at the moment the drawer is slid forward so that the dump orifices are no longer aligned with and top of the horizontal flange and when grooves 176 are no longer abutting backing plate 100*c*. At this moment, the conduit 171 also disconnects from the feed line (e.g., 140 as illustrated in FIG. 11). The net effect of these actions is that water may flow freely through the dump orifices and grooves, causing the quench drawer to empty in a matter of a few seconds. If faster evacuation is desired, tabs 175 may be bend upwardly or removed to increase the outflow area for the cooling water. When the drawer is pushed back into the chest all the way, the water connection o-ring 171*b* reconnects to tapered end 171*a* of conduit to place conduit 171 into fluid communication with feed line (e.g., 140), and the leaking through dump holes is substantially eliminated or at least substantially decreased by effectively blocking the dump holes and grooves by way of shelves bow and backing plate 100*c*.

As referenced above, the drawers are fed with cold water by way of interconnecting with a fitment/o-ring 171*b* at the back of the cooler 10 (such as between backing plate 100*c* and back wall 108 of tank 100 that is fed by vertically oriented feed lines 140, 150, wherein feed line 140 feeds lower drawer 180, and upper feed line 150 feeds upper drawer 170. Similarly, feed line 160 feeds upper tray 46. As alluded to above, FIG. 11 is a cross sectional view of lower slidable drawer 180 showing a cooling conduit 171 in the drawer being received by an output of one of the feed tubes 140. When fully pushed into the chest, drawer 180 abuts against the backing plate 100*c* of the tank 100 and fluid communication is established between the feed and the drawer 180, permitting the drawer 180 to fill with water to quench the beverages. Thus, when the middle and lower quench trays 170, 180 are pulled out and/or removed through the front access door 30, water that was contained in the quench tray is drained as described above. This allows for a beverage to be removed from the middle and lower quench tray 170, 180 without water substantially being spilled or leaked outside of the cooling chest 10, thereby also helping to prevent a slippery surface (e.g., patio).

Thus, in certain aspects, the present disclosure allows for the continuous production of ice which is then delivered into the cooling chest. The ice acts as a continuous coolant for water that is guided into the cooling chest though a plurality of pipe fittings. This uninterrupted and, if desired, continuous, flow of cold water is guided through a series of pipes and feeding tubes into the plurality of quench trays which contain beverage containers of various sizes and shapes. Beverages containers are kept submerged in a continuous flow of cold water. Beverages can be loaded and locked into place via an adjustable grate or divider. Beverages can be removed from the upper quench tray from the top access door. Beverages can also be removed by withdrawing the middle and lower quench trays from the front access door as you would pull out a dresser drawer. As the middle or lower quench tray is removed thought the front access door, the water contained in the submerged quench trays is drained out through a plurality of openings located on the quench trays that lead to exit feeding tubes to allow for beverages to be removed without the spillage of water.

In another embodiment of the disclosure and as illustrated in FIG. 14, the cooling chest may be a relatively, smaller, portable unit adapted to be movable on wheels, with the assistance of a rotatable lift bar, and the like. The particular schematic illustrated shows a cooling chest 1410 that has portability features similar to a portable electric generator including a pair of wheels 1430, a resting post 1450 for the opposite end of the unit, and a pivoting handle 1460 or lift bar at one end that may be pivoted upwardly to lift the end of the cooling chest 1410 and roll it on the wheels 1430. Such a portable version of the chest 1410 can be powered by a portable power source, such a hydrocarbon gas, propane, an electrochemical fuel cell, solar power, a generator, and the like 1420. The gas can be propane, ethanol, natural gas, a mixture thereof, and the like. The source of the gas can be an individualized gas tank such as a propane tank used for an outdoor barbecue or the gas can originate from a different stationary or portable source. Advantageously, this can permit the cooling chest to be untethered to an electrical source and be portable for use in a variety of remote locations where electricity may not be available. A chest with these functionalities can be suitable for military operations, disaster relief and recovery locations; RV parks; tailgating events at stadiums and food trucks. In this embodiment of the invention, the cooling chest is portable, and is preferably filled with a quantity of water that can be recycled with minimal losses so that melted ice can be recycled and turned back into ice. The ice cools the beverages held in the chest and once the ice is melted, the chilled water is circulated back into the ice maker for further production of ice. It will be appreciated that such a portable chest can have any or all of the features of the chest that is specifically illustrated, but may have any subset of those features, such as a plurality of drawers as illustrated in FIG. 14. Preferably, the portable cooling chest flowed chilled water over containers therein.

Exemplary Computer Controlled Cooling Chest Systemization

An exemplary control system is depicted in FIG. 12 for operating cooling chest 10 as described herein. An operator interface and control console 250 (FIG. 1) including a controller 255 can be provided on the cooling chest units 10 if desired, such as via a touch screen operated programmable controller that can operate the ice maker 68 and pumps 202, 204, 206 (FIG. 10) to selectively deliver chilled water to each cooling tray via conduits 140, 150, 160 as well as a water input connected to a source (not shown) via a solenoid in response to various inputs, such as beverage temperature, cooling water temperature, beverage quantity, and desired cooling time.

Preferably, pumps 202, 204, 206 operate at a desired flow rate (continuously or intermittently, as desired) until a predetermine (e.g., preset) temperature is achieved in each drawer. Sensors 212, 214, 216 (FIG. 10) can be mounted in any suitable location on, in or proximate each cooling tray to monitor the temperature of the beverages. When the desired temperature is reached for one of the trays, the controller 255 can shut off the pump cooling the particular tray, and an indicator light, buzzer or the like (e.g., on control panel 250 or on or near the particular tray) can be actuated indicating that the desired temperature in a drawer has been achieved.

If desired, in addition or alternatively, cooling chest 10 can be operated, monitored and controlled remotely via a mobile device 200, such as a smart phone or remote computer terminal via a server 300. Instructions can be input by a user via the remote/mobile device via a server that is in communication with a controller onboard the cooling chest 10 to operate the cooling chest in any desired manner, such as via wireless network and the like, as described below. When a desired cooling temperature is reached, the controller 255 can send a signal via a network to the mobile device 200 indicating that the temperature has been reached. Cooling curves can similarly be graphically represented on the user interface of the mobile device 300 (and/or on control panel 250) as desired.

Example—BQ™ Controller

FIG. 13 illustrates inventive aspects of a BQ™ controller 601 for controlling a system such as that illustrated in FIG. 12 implementing some of the embodiments disclosed herein. In this embodiment, the BQ™ controller 601 may serve to aggregate, process, store, search, serve, identify, instruct, generate, match, and/or facilitate interactions with a computer through various technologies, and/or other related data.

Typically, a user or users, e.g., 633*a*, which may be people or groups of users and/or other systems, may engage information technology systems (e.g., computers) to facilitate operation of the system and information processing. In turn, computers employ processors to process information; such processors 603 may be referred to as central processing units (CPU). One form of processor is referred to as a microprocessor. CPUs use communicative circuits to pass binary encoded signals acting as instructions to enable various operations. These instructions may be operational and/or data instructions containing and/or referencing other instructions and data in various processor accessible and operable areas of memory 629 (e.g., registers, cache memory, random access memory, etc.). Such communicative instructions may be stored and/or transmitted in batches (e.g., batches of instructions) as programs and/or data components to facilitate desired operations. These stored instruction codes, e.g., programs, may engage the CPU circuit components and other motherboard and/or system components to perform desired operations. One type of program is a computer operating system, which, may be executed by CPU on a computer; the operating system enables and facilitates users to access and operate computer information technology and resources. Some resources that may be employed in information technology systems include: input and output mechanisms through which data may pass into and out of a computer; memory storage into which data may be saved; and processors by which information may be processed. These information technology systems may be used to collect data for later retrieval, analysis, and manipulation, which may be facilitated through a database program. These information technology systems provide interfaces that allow users to access and operate various system components.

In one embodiment, the BQ™ controller 601 may be connected to and/or communicate with entities such as, but not limited to: one or more users from user input devices 611; peripheral devices 612, components of the cooling chest to; an optional cryptographic processor device 628; and/or a communications network 613. For example, the BQ™ controller 601 may be connected to and/or communicate with users, e.g., 633*a*, operating client device(s), e.g., 633*b*, including, but not limited to, personal computer(s), server(s) and/or various mobile device(s) including, but not limited to, cellular telephone(s), smartphone(s) (e.g., iPhone®, Blackberry®, Android OS-based phones etc.), tablet computer(s) (e.g., Apple iPad™, HP Slate™, Motorola Xoom™, etc.), eBook reader(s) (e.g., Amazon Kindle™, Barnes and Noble's Nook™ eReader, etc.), laptop computer(s), notebook(s), netbook(s), gaming console(s) (e.g., XBOX Live™, Nintendo® DS, Sony PlayStation® Portable, etc.), portable scanner(s) and/or the like.

Networks are commonly thought to comprise the interconnection and interoperation of clients, servers, and intermediary nodes in a graph topology. It should be noted that the term "server" as used throughout this application refers generally to a computer, other device, program, or combination thereof that processes and responds to the requests of remote users across a communications network. Servers serve their information to requesting "clients." The term "client" as used herein refers generally to a computer, program, other device, user and/or combination thereof that is capable of processing and making requests and obtaining and processing any responses from servers across a communications network. A computer, other device, program, or combination thereof that facilitates, processes information and requests, and/or furthers the passage of information from a source user to a destination user is commonly referred to as a "node." Networks are generally thought to facilitate the transfer of information from source points to destinations. A node specifically tasked with furthering the passage of information from a source to a destination is commonly called a "router." There are many forms of networks such as Local Area Networks (LANs), Pico networks, Wide Area Networks (WANs), Wireless Networks (WLANs), etc. For example, the Internet is generally accepted as being an interconnection of a multitude of networks whereby remote clients and servers may access and interoperate with one another.

The BQ™ controller 601 may be based on computer systems that may comprise, but are not limited to, components such as: a computer systemization 602 connected to memory 629.

Computer Systemization

A computer systemization 602 may comprise a clock 630, central processing unit ("CPU(s)" and/or "processor(s)" (these terms are used interchangeable throughout the disclosure unless noted to the contrary)) 603, a memory 629 (e.g., a read only memory (ROM) 606, a random access memory (RAM) 605, etc.), and/or an interface bus 607, and most frequently, although not necessarily, are all interconnected and/or communicating through a system bus 604 on one or more (mother)board(s) 602 having conductive and/or otherwise transportive circuit pathways through which instructions (e.g., binary encoded signals) may travel to effect communications, operations, storage, etc. Optionally, the computer systemization may be connected to an internal power source 686; e.g., optionally the power source may be internal. Optionally, a cryptographic processor 626 and/or transceivers (e.g., ICs) 674 may be connected to the system bus. In another embodiment, the cryptographic processor and/or transceivers may be connected as either internal and/or external peripheral devices 612 via the interface bus I/O. In turn, the transceivers may be connected to antenna(s) 675, thereby effectuating wireless transmission and reception of various communication and/or sensor protocols; for example the antenna(s) may connect to: a Texas Instruments WiLink WL1283 transceiver chip (e.g., providing 802.11n, Bluetooth 3.0, FM, global positioning system (GPS) (thereby allowing BQ™ controller to determine its location)); Broadcom BCM4329FKUBG transceiver chip (e.g., providing 802.11n, Bluetooth 2.1+EDR, FM, etc.); a Broadcom BCM4750IUB8 receiver chip (e.g., GPS); an Infineon Technologies X-Gold 618-PMB9800 (e.g., providing 2G/3G HSDPA/HSUPA communications); and/or the like. The system clock typically has a crystal oscillator and generates a base signal through the computer systemization's circuit pathways. The clock is typically coupled to the system bus and various clock multipliers that will increase or decrease the base operating frequency for other components interconnected in the computer systemization. The clock and various components in a computer systemization drive signals embodying information throughout the system. Such transmission and reception of instructions embodying information throughout a computer systemization may be commonly referred to as communications. These communicative instructions may further be transmitted, received, and the cause of return and/or reply communications beyond the instant computer systemization to: communications networks, input devices, other computer systemizations, peripheral devices, and/or the like. Of course, any of the above components may be connected directly to one another, connected to the CPU, and/or organized in numerous variations employed as exemplified by various computer systems.

The CPU comprises at least one high-speed data processor adequate to execute program components for executing user and/or system-generated requests. Often, the processors themselves will incorporate various specialized processing units, such as, but not limited to: integrated system (bus) controllers, memory management control units, floating point units, and even specialized processing sub-units like graphics processing units, digital signal processing units, and/or the like. Additionally, processors may include internal fast access addressable memory, and be capable of mapping and addressing memory 629 beyond the processor itself; internal memory may include, but is not limited to: fast registers, various levels of cache memory (e.g., level 1, 2, 3, etc.), RAM, etc. The processor may access this memory through the use of a memory address space that is accessible via instruction address, which the processor can construct and decode allowing it to access a circuit path to a specific memory address space having a memory state. The CPU may be a microprocessor such as: AMD's Athlon, Duron and/or Opteron; ARM's application, embedded and secure processors; IBM and/or Motorola's DragonBall and PowerPC;

IBM's and Sony's Cell processor; Intel's Celeron, Core (2) Duo, Itanium, Pentium, Xeon, and/or XScale; and/or the like processor(s). The CPU interacts with memory through instruction passing through conductive and/or transportive conduits (e.g., (printed) electronic and/or optic circuits) to execute stored instructions (i.e., program code) according to conventional data processing techniques. Such instruction passing facilitates communication within the BQ™ controller and beyond through various interfaces. Should processing requirements dictate a greater amount speed and/or capacity, distributed processors (e.g., Distributed BQ™ embodiments), mainframe, multi-core, parallel, and/or super-computer architectures may similarly be employed. Alternatively, should deployment requirements dictate greater portability, smaller Personal Digital Assistants (PDAs) may be employed.

Depending on the particular implementation, features of the BQ™ implementations may be achieved by implementing a microcontroller such as CAST's R8051XC2 microcontroller; Intel's MCS 51 (i.e., 8051 microcontroller); and/or the like. Also, to implement certain features of the BQ™ embodiments, some feature implementations may rely on embedded components, such as: Application-Specific Integrated Circuit ("ASIC"), Digital Signal Processing ("DSP"), Field Programmable Gate Array ("FPGA"), and/or the like embedded technology. For example, any of the BQ™ component collection (distributed or otherwise) and/or features may be implemented via the microprocessor and/or via embedded components; e.g., via ASIC, coprocessor, DSP, FPGA, and/or the like. Alternately, some implementations of the BQ™ may be implemented with embedded components that are configured and used to achieve a variety of features or signal processing.

Depending on the particular implementation, the embedded components may include software solutions, hardware solutions, and/or some combination of both hardware/software solutions. For example, BQ™ features discussed herein may be achieved through implementing FPGAs, which are a semiconductor devices containing programmable logic components called "logic blocks", and programmable interconnects, such as the high performance FPGA Virtex series and/or the low cost Spartan series manufactured by Xilinx. Logic blocks and interconnects can be programmed by the customer or designer, after the FPGA is manufactured, to implement any of the BQ™ features. A hierarchy of programmable interconnects allow logic blocks to be interconnected as needed by the BQ™ system designer/administrator, somewhat like a one-chip programmable breadboard. An FPGA's logic blocks can be programmed to perform the function of basic logic gates such as AND, and XOR, or more complex combinational functions such as decoders or simple mathematical functions. In most FPGAs, the logic blocks also include memory elements, which may be simple flip-flops or more complete blocks of memory. In some circumstances, the BQ™ may be developed on regular FPGAs and then migrated into a fixed version that more resembles ASIC implementations. Alternate or coordinating implementations may migrate BQ™ controller features to a final ASIC instead of or in addition to FPGAs. Depending on the implementation all of the aforementioned embedded components and microprocessors may be considered the "CPU" and/or "processor" for the BQ™

Power Source

The power source 686 may be of any standard form for powering small electronic circuit board devices such as the following power cells: alkaline, lithium hydride, lithium ion, lithium polymer, nickel cadmium, solar cells, and/or the like. Other types of AC or DC power sources may be used as well. In the case of solar cells, in one embodiment, the case provides an aperture through which the solar cell may capture photonic energy. The power cell 686 is connected to at least one of the interconnected subsequent components of the BQ™ thereby providing an electric current to all subsequent components. In one example, the power source 686 is connected to the system bus component 604. In an alternative embodiment, an outside power source 686 is provided through a connection across the I/O 608 interface. For example, a USB and/or IEEE 1394 connection carries both data and power across the connection and is therefore a suitable source of power.

Interface Adapters

Interface bus(ses) 607 may accept, connect, and/or communicate to a number of interface adapters, conventionally although not necessarily in the form of adapter cards, such as but not limited to: input output interfaces (I/O) 608, storage interfaces 609, network interfaces 610, and/or the like. Optionally, cryptographic processor interfaces 627 similarly may be connected to the interface bus. The interface bus provides for the communications of interface adapters with one another as well as with other components of the computer systemization. Interface adapters are adapted for a compatible interface bus. Interface adapters conventionally connect to the interface bus via a slot architecture. Conventional slot architectures may be employed, such as, but not limited to: Accelerated Graphics Port (AGP), Card Bus, (Extended) Industry Standard Architecture ((E)ISA), Micro Channel Architecture (MCA), NuBus, Peripheral Component Interconnect (Extended) (PCI(X)), PCI Express, Personal Computer Memory Card International Association (PCMCIA), and/or the like.

Storage interfaces 609 may accept, communicate, and/or connect to a number of storage devices such as, but not limited to: storage devices 614, removable disc devices, and/or the like. Storage interfaces may employ connection protocols such as, but not limited to: (Ultra) (Serial) Advanced Technology Attachment (Packet Interface) ((Ultra) (Serial) ATA(PI)), (Enhanced) Integrated Drive Electronics ((E)IDE), Institute of Electrical and Electronics Engineers (IEEE) 1394, fiber channel, Small Computer Systems Interface (SCSI), Universal Serial Bus (USB), and/or the like.

Network interfaces 610 may accept, communicate, and/or connect to a communications network 613. Through a communications network 613, the BQ™ controller is accessible through remote clients 633*b* (e.g., computers with web browsers) by users 633*a*. Network interfaces may employ connection protocols such as, but not limited to: direct connect, Ethernet (thick, thin, twisted pair 10/100/1000 Base T, and/or the like), Token Ring, wireless connection such as IEEE 802.11a-x, and/or the like. Should processing requirements dictate a greater amount speed and/or capacity, distributed network controllers (e.g., Distributed BQ™), architectures may similarly be employed to pool, load balance, and/or otherwise increase the communicative bandwidth required by the BQ™ controller. A communications network may be any one and/or the combination of the following: a direct interconnection; the Internet; a Local Area Network (LAN); a Metropolitan Area Network (MAN); an Operating Missions as Nodes on the Internet (OMNI); a secured custom connection; a Wide Area Network (WAN); a wireless network (e.g., employing protocols such as, but not limited to a Wireless Application Protocol (WAP), I-mode, and/or the like); and/or the like. A network interface may be regarded as a specialized form of an input output interface. Further, multiple network interfaces 610 may be used to engage with various communications network types 613. For example, multiple network interfaces may be employed to allow for the communication over broadcast, multicast, and/or unicast networks.

Input Output interfaces (I/O) 608 may accept, communicate, and/or connect to user input devices 611, peripheral devices 612, cryptographic processor devices 628, and/or the like. I/O may employ connection protocols such as, but not limited to: audio: analog, digital, monaural, RCA, stereo, and/or the like; data: Apple Desktop Bus (ADB), IEEE 1394a-b, serial, universal serial bus (USB); infrared; joystick; keyboard; midi; optical; PC AT; PS/2; parallel; radio; video interface: Apple Desktop Connector (ADC), BNC, coaxial, component, composite, digital, Digital Visual Interface (DVI), high-definition multimedia interface (HDMI), RCA, RF antennae, S-Video, VGA, and/or the like; wireless transceivers: 802.11a/b/g/n/x; Bluetooth; cellular (e.g., code division multiple access (CDMA), high speed packet access (HSPA(+)), high-speed downlink packet access (HSDPA), global system for mobile communications (GSM), long term evolution (LTE), WiMax, etc.); and/or the like. One typical output device may include a video display, which typically comprises a Cathode Ray Tube (CRT) or Liquid Crystal Display (LCD) based monitor with an interface (e.g., DVI circuitry and cable) that accepts signals from a video interface, may be used. The video interface composites information generated by a computer systemization and generates video signals based on the composited information in a video memory frame. Another output device is a television set, which accepts signals from a video interface. Typically, the video interface provides the composited video information through a video connection interface that accepts a video display interface (e.g., an RCA composite video connector accepting an RCA composite video cable; a DVI connector accepting a DVI display cable, etc.).

User input devices 611 often are a type of peripheral device 612 (see below) and may include: card readers, dongles, finger print readers, gloves, graphics tablets, joysticks, keyboards, microphones, mouse (mice), remote controls, retina readers, touch screens (e.g., capacitive, resistive, etc.), trackballs, trackpads, sensors (e.g., accelerometers, ambient light, GPS, gyroscopes, proximity, etc.), styluses, and/or the like.

Peripheral devices 612, such as other components of the cooling chest system 10, including temperature sensors, ice dispensers (if provided) and the like may be connected and/or communicate to I/O and/or other facilities of the like such as network interfaces, storage interfaces, directly to the interface bus, system bus, the CPU, and/or the like. Peripheral devices may be external, internal and/or part of the BQ™ controller. Peripheral devices may also include, for example, an antenna, audio devices (e.g., line-in, line-out, microphone input, speakers, etc.), cameras (e.g., still, video, webcam, etc.), drive motors, ice maker 68, lighting, video monitors and/or the like.

Cryptographic units such as, but not limited to, microcontrollers, processors 626, interfaces 627, and/or devices 628 may be attached, and/or communicate with the BQ™ controller. A MC68HC16 microcontroller, manufactured by Motorola Inc., may be used for and/or within cryptographic units. The MC68HC16 microcontroller utilizes a 16-bit multiply-and-accumulate instruction in the 16 MHz configuration and requires less than one second to perform a 512-bit RSA private key operation. Cryptographic units support the authentication of communications from interacting agents, as well as allowing for anonymous transactions. Cryptographic units may also be configured as part of CPU. Equivalent microcontrollers and/or processors may also be used. Other commercially available specialized cryptographic processors include: the Broadcom's CryptoNetX and other Security Processors; nCipher's nShield, SafeNet's Luna PCI (e.g., 7100) series; Semaphore Communications' 40 MHz Roadrunner 184; Sun's Cryptographic Accelerators (e.g., Accelerator 6000 PCIe Board, Accelerator 500 Daughtercard); Via Nano Processor (e.g., L2100, L2200, U2400) line, which is capable of performing 500+MB/s of cryptographic instructions; VLSI Technology's 33 MHz 6868; and/or the like.

Memory

Generally, any mechanization and/or embodiment allowing a processor to affect the storage and/or retrieval of information is regarded as memory 629 (or 68, 72, etc.). However, memory is a fungible technology and resource, thus, any number of memory embodiments may be employed in lieu of or in concert with one another. It is to be understood that the BQ™ controller and/or a computer systemization may employ various forms of memory 629. For example, a computer systemization may be configured wherein the functionality of on-chip CPU memory (e.g., registers), RAM, ROM, and any other storage devices are provided by a paper punch tape or paper punch card mechanism; of course such an embodiment would result in an extremely slow rate of operation. In a typical configuration, memory 629 will include ROM 606, RAM 605, and a storage device 614. A storage device 614 may be any conventional computer system storage. Storage devices may include a drum; a (fixed and/or removable) magnetic disk drive; a magneto-optical drive; an optical drive (i.e., Blueray, CD ROM/RAM/Recordable (R)/ReWritable (RW), DVD R/RW, HD DVD R/RW etc.); an array of devices (e.g., Redundant Array of Independent Disks (RAID)); solid state memory devices (USB memory, solid state drives (SSD), etc.); other processor-readable storage mediums; and/or other devices of the like. Thus, a computer systemization generally requires and makes use of memory.

Component Collection

The memory 629 may contain a collection of program and/or database components and/or data such as, but not limited to: operating system component(s) 615 (operating system); information server component(s) 616 (information server); user interface component(s) 617 (user interface); Web browser component(s) 618 (Web browser); database(s) 619; mail server component(s) 621; mail client component(s) 622; cryptographic server component(s) 620 (cryptographic server) and/or the like (i.e., collectively a component collection). These components may be stored and accessed from the storage devices and/or from storage devices accessible through an interface bus. Although non-conventional program components such as those in the component collection, typically, are stored in a local storage device 614, they may also be loaded and/or stored in memory such as: peripheral devices, RAM, remote storage facilities through a communications network, ROM, various forms of memory, and/or the like.

Operating System

The operating system component 615 is an executable program component facilitating the operation of the BQ™ controller. Typically, the operating system facilitates access of I/O, network interfaces, peripheral devices, storage devices, and/or the like. The operating system may be a highly fault tolerant, scalable, and secure system such as: Apple Macintosh OS X (Server); AT&T Nan 9; Be OS; Unix and Unix-like system distributions (such as AT&T's UNIX; Berkley Software Distribution (BSD) variations such as FreeBSD, NetBSD, OpenBSD, and/or the like; Linux distributions such as Red Hat, Ubuntu, and/or the like); and/or the like operating systems. However, more limited and/or less secure operating systems also may be employed such as Apple Macintosh OS, IBM OS/2, Microsoft DOS, Microsoft Windows 2000/2003/

3.1/95/98/CE/Millenium/NT/Vista/XP (Server), Palm OS, and/or the like. An operating system may communicate to and/or with other components in a component collection, including itself, and/or the like. Most frequently, the operating system communicates with other program components, user interfaces, and/or the like. For example, the operating system may contain, communicate, generate, obtain, and/or provide program component, system, user, and/or data communications, requests, and/or responses. The operating system, once executed by the CPU, may enable the interaction with communications networks, data, I/O, peripheral devices, program components, memory, user input devices, and/or the like. The operating system may provide communications protocols that allow the BQ™ controller to communicate with other entities through a communications network 613. Various communication protocols may be used by the BQ™ controller as a subcarrier transport mechanism for interaction, such as, but not limited to: multicast, TCP/IP, UDP, unicast, and/or the like.

Information Server

An information server component 616 is a stored program component that is executed by a CPU. The information server may be a conventional Internet information server such as, but not limited to Apache Software Foundation's Apache, Microsoft's Internet Information Server, and/or the like. The information server may allow for the execution of program components through facilities such as Active Server Page (ASP), ActiveX, (ANSI) (Objective–) C (++), C# and/or .NET, Common Gateway Interface (CGI) scripts, dynamic (D) hypertext markup language (HTML), FLASH, Java, JavaScript, Practical Extraction Report Language (PERL), Hypertext Pre-Processor (PHP), pipes, Python, wireless application protocol (WAP), WebObjects, and/or the like. The information server may support secure communications protocols such as, but not limited to, File Transfer Protocol (FTP); HyperText Transfer Protocol (HTTP); Secure Hypertext Transfer Protocol (HTTPS), Secure Socket Layer (SSL), messaging protocols (e.g., America Online (AOL) Instant Messenger (AIM), Application Exchange (APEX), ICQ, Internet Relay Chat (IRC), Microsoft Network (MSN) Messenger Service, Presence and Instant Messaging Protocol (PRIM), Internet Engineering Task Force's (IETF's) Session Initiation Protocol (SIP), SIP for Instant Messaging and Presence Leveraging Extensions (SIMPLE), open XML-based Extensible Messaging and Presence Protocol (XMPP) (i.e., Jabber or Open Mobile Alliance's (OMA's) Instant Messaging and Presence Service (IMPS)), Yahoo! Instant Messenger Service, and/or the like. The information server provides results in the form of Web pages to Web browsers, and allows for the manipulated generation of the Web pages through interaction with other program components. After a Domain Name System (DNS) resolution portion of an HTTP request is resolved to a particular information server, the information server resolves requests for information at specified locations on the BQ™ controller based on the remainder of the HTTP request. For example, a request such as http://123.124.125.126/myInformation.html might have the IP portion of the request "123.124.125.126" resolved by a DNS server to an information server at that IP address; that information server might in turn further parse the http request for the "/myInformation.html" portion of the request and resolve it to a location in memory containing the information "myInformation.html." Additionally, other information serving protocols may be employed across various ports, e.g., FTP communications across port 21, and/or the like. An information server may communicate to and/or with other components in a component collection, including itself, and/or facilities of the like. Most frequently, the information server communicates with the BQ™ database 619, operating systems, other program components, user interfaces, Web browsers, and/or the like.

Access to the BQ™ database may be achieved through a number of database bridge mechanisms such as through scripting languages as enumerated below (e.g., CGI) and through inter-application communication channels as enumerated below (e.g., CORBA, WebObjects, etc.). Any data requests through a Web browser are parsed through the bridge mechanism into appropriate grammars as required by the BQ™. In one embodiment, the information server would provide a Web form accessible by a Web browser. Entries made into supplied fields in the Web form are tagged as having been entered into the particular fields, and parsed as such. The entered terms are then passed along with the field tags, which act to instruct the parser to generate queries directed to appropriate tables and/or fields. In one embodiment, the parser may generate queries in standard SQL by instantiating a search string with the proper join/select commands based on the tagged text entries, wherein the resulting command is provided over the bridge mechanism to the BQ™ as a query. Upon generating query results from the query, the results are passed over the bridge mechanism, and may be parsed for formatting and generation of a new results Web page by the bridge mechanism. Such a new results Web page is then provided to the information server, which may supply it to the requesting Web browser.

Also, an information server may contain, communicate, generate, obtain, and/or provide program component, system, user, and/or data communications, requests, and/or responses.

User Interface

Computer interfaces in some respects are similar to automobile operation interfaces. Automobile operation interface elements such as steering wheels, gearshifts, and speedometers facilitate the access, operation, and display of automobile resources, and status. Computer interaction interface elements such as check boxes, cursors, menus, scrollers, and windows (collectively and commonly referred to as widgets) similarly facilitate the access, capabilities, operation, and display of data and computer hardware and operating system resources, and status. Operation interfaces are commonly called user interfaces. Graphical user interfaces (GUIs) such as the Apple Macintosh Operating System's Aqua, IBM's OS/2, Microsoft's Windows 2000/2003/3.1/95/98/CE/Millenium/NT/XP/Vista/7 (i.e., Aero), Unix's X-Windows (e.g., which may include additional Unix graphic interface libraries and layers such as K Desktop Environment (KDE), mythTV and GNU Network Object Model Environment (GNOME)), web interface libraries (e.g., ActiveX, AJAX, (D)HTML, FLASH, Java, JavaScript, etc. interface libraries such as, but not limited to, Dojo, jQuery(UI), MooTools, Prototype, script.aculo.us, SWFObject, Yahoo! User Interface, any of which may be used and) provide a baseline and means of accessing and displaying information graphically to users.

A user interface component 617 is a stored program component that is executed by a CPU. The user interface may be a conventional graphic user interface as provided by, with, and/or atop operating systems and/or operating environments such as already discussed. The user interface may allow for the display, execution, interaction, manipulation, and/or operation of program components and/or system facilities through textual and/or graphical facilities. The user interface provides a facility through which users may affect, interact, and/or operate a computer system. A user interface may communicate to and/or with other components in a component collection, including itself, and/or facilities of the like. Most frequently, the user interface communicates with operating systems, other program components, and/or the like. The user interface may contain, communicate, generate, obtain, and/or provide program component, system, user, and/or data communications, requests, and/or responses.

Web Browser

A Web browser component 618 is a stored program component that is executed by a CPU. The Web browser may be a conventional hypertext viewing application such as Microsoft Internet Explorer or Netscape Navigator. Secure Web browsing may be supplied with 128 bit (or greater) encryption by way of HTTPS, SSL, and/or the like. Web browsers allowing for the execution of program components through facilities such as ActiveX, AJAX, (D)HTML, FLASH, Java, JavaScript, web browser plug-in APIs (e.g., FireFox, Safari Plug-in, and/or the like APIs), and/or the like. Web browsers and like information access tools may be integrated into PDAs, cellular telephones, and/or other mobile devices. A Web browser may communicate to and/or with other components in a component collection, including itself, and/or facilities of the like. Most frequently, the Web browser communicates with information servers, operating systems, integrated program components (e.g., plug-ins), and/or the like; e.g., it may contain, communicate, generate, obtain, and/or provide program component, system, user, and/or data communications, requests, and/or responses. Of course, in place of a Web browser and information server, a combined application may be developed to perform similar functions of both. The combined application would similarly affect the obtaining and the provision of information to users, user agents, and/or the like from the BQ™ enabled nodes. The combined application may be nugatory on systems employing standard Web browsers.

Mail Server

A mail server component 621 is a stored program component that is executed by a CPU 603. The mail server may be a conventional Internet mail server such as, but not limited to sendmail, Microsoft Exchange, and/or the like. The mail server may allow for the execution of program components through facilities such as ASP, ActiveX, (ANSI) (Objective–) C (++), C# and/or .NET, CGI scripts, Java, JavaScript, PERL, PHP, pipes, Python, WebObjects, and/or the like. The mail server may support communications protocols such as, but not limited to: Internet message access protocol (IMAP), Messaging Application Programming Interface (MAPI)/Microsoft Exchange, post office protocol (POP3), simple mail transfer protocol (SMTP), and/or the like. The mail server can route, forward, and process incoming and outgoing mail messages that have been sent, relayed and/or otherwise traversing through and/or to the BQ™

Access to the BQ™ mail may be achieved through a number of APIs offered by the individual Web server components and/or the operating system.

Also, a mail server may contain, communicate, generate, obtain, and/or provide program component, system, user, and/or data communications, requests, information, and/or responses.

Mail Client

A mail client component 622 is a stored program component that is executed by a CPU 603. The mail client may be a conventional mail viewing application such as Apple Mail, Microsoft Entourage, Microsoft Outlook, Microsoft Outlook Express, Mozilla, Thunderbird, and/or the like. Mail clients may support a number of transfer protocols, such as: IMAP, Microsoft Exchange, POP3, SMTP, and/or the like. A mail client may communicate to and/or with other components in a component collection, including itself, and/or facilities of the like. Most frequently, the mail client communicates with mail servers, operating systems, other mail clients, and/or the like; e.g., it may contain, communicate, generate, obtain, and/or provide program component, system, user, and/or data communications, requests, information, and/or responses. Generally, the mail client provides a facility to compose and transmit electronic mail messages.

Cryptographic Server

A cryptographic server component 620 is a stored program component that is executed by a CPU 603, cryptographic processor 626, cryptographic processor interface 627, cryptographic processor device 628, and/or the like. Cryptographic processor interfaces will allow for expedition of encryption and/or decryption requests by the cryptographic component; however, the cryptographic component, alternatively, may run on a conventional CPU. The cryptographic component allows for the encryption and/or decryption of provided data. The cryptographic component allows for both symmetric and asymmetric (e.g., Pretty Good Protection (PGP)) encryption and/or decryption. The cryptographic component may employ cryptographic techniques such as, but not limited to: digital certificates (e.g., X.509 authentication framework), digital signatures, dual signatures, enveloping, password access protection, public key management, and/or the like. The cryptographic component will facilitate numerous (encryption and/or decryption) security protocols such as, but not limited to: checksum, Data Encryption Standard (DES), Elliptical Curve Encryption (ECC), International Data Encryption Algorithm (IDEA), Message Digest 5 (MD5, which is a one way hash function), passwords, Rivest Cipher (RC5), Rijndael, RSA (which is an Internet encryption and authentication system that uses an algorithm developed in 1977 by Ron Rivest, Adi Shamir, and Leonard Adleman), Secure Hash Algorithm (SHA), Secure Socket Layer (SSL), Secure Hypertext Transfer Protocol (HTTPS), and/or the like. Employing such encryption security protocols, the BQ™ may encrypt all incoming and/or outgoing communications and may serve as node within a virtual private network (VPN) with a wider communications network. The cryptographic component facilitates the process of "security authorization" whereby access to a resource is inhibited by a security protocol wherein the cryptographic component effects authorized access to the secured resource. In addition, the cryptographic component may provide unique identifiers of content, e.g., employing and MD5 hash to obtain a unique signature for an digital audio file. A cryptographic component may communicate to and/or with other components in a component collection, including itself, and/or facilities of the like. The cryptographic component supports encryption schemes allowing for the secure transmission of information across a communications network to enable the BQ™ component to engage in secure transactions if so desired. The cryptographic component facilitates the secure accessing of resources on the BQ™ and facilitates the access of secured resources on remote systems; i.e., it may act as a client and/or server of secured resources. Most frequently, the cryptographic component communicates with information servers, operating systems, other program components, and/or the like. The cryptographic component may contain, communicate, generate, obtain, and/or provide program component, system, user, and/or data communications, requests, and/or responses.

The BQ™ Database

The BQ™ database component 619 may be embodied in a database and its stored data. The database is a stored program component, which is executed by the CPU; the stored program component portion configuring the CPU to process the stored data. The database may be a conventional, fault tolerant, relational, scalable, secure database such as Oracle or Sybase. Relational databases are an extension of a flat file. Relational databases consist of a series of related tables. The tables are interconnected via a key field. Use of the key field allows the combination of the tables by indexing against the key field; i.e., the key fields act as dimensional pivot points for combining information from various tables. Relationships generally identify links maintained between tables by matching primary keys. Primary keys represent fields that uniquely identify the rows of a table in a relational database. More precisely, they uniquely identify rows of a table on the "one" side of a one-to-many relationship.

Alternatively, the BQ™ database may be implemented using various standard data-structures, such as an array, hash, (linked) list, struct, structured text file (e.g., XML), table, and/or the like. Such data-structures may be stored in memory and/or in (structured) files. In another alternative, an object-oriented database may be used, such as Frontier, ObjectStore, Poet, Zope, and/or the like. Object databases can include a number of object collections that are grouped and/or linked together by common attributes; they may be related to other object collections by some common attributes. Object-oriented databases perform similarly to relational databases with the exception that objects are not just pieces of data but may have other types of functionality encapsulated within a given object. If the BQ™ database is implemented as a data-structure, the use of the BQ™ database 619 may be integrated into another component such as the BQ™ component 635. Also, the database may be implemented as a mix of data structures, objects, and relational structures. Databases may be consolidated and/or distributed in countless variations through standard data processing techniques. Portions of databases, e.g., tables, may be exported and/or imported and thus decentralized and/or integrated.

In one embodiment, the database component 619 includes several tables 619*a-n*. A Users (e.g., operators and physicians) table 619*a* may include fields such as, but not limited to: user_id, ssn, dob, first_name, last_name, age, state, address_firstline, address_secondline, zipcode, devices_list, contact_info, contact_type, alt_contact_info, alt_contact_type, and/or the like to refer to any type of enterable data or selections discussed herein. The Users table may support and/or track multiple entity accounts. A Clients table 619*b* may include fields such as, but not limited to: user_id, client_id, client_ip, client_type, client_model, operating_system, os_version, app_installed_flag, and/or the like. An Apps table 619*c* may include fields such as, but not limited to: app_ID, app_name, app_type, OS compatibilities_list, version, timestamp, developer_ID, and/or the like. A beverages table 619*d* including, for example, heat capacities and other useful parameters of different beverages, such as depending on size beverage_name, beverage_size, desired_coolingtemp, cooling_time, favorite_drinker, number_of_beverages, current_beverage_temperature, current_ambient_temperature, and/or the like. An Parameter table 619*e* may include fields including the foregoing fields, or additional ones such as cool_start_time, cool_preset, cooling_rate, and/or the like. A Cool Routines table 619*f* may include a plurality of cooling sequences may include fields such as, but not limited to: sequence_type, sequence_id, flow_rate, avg_water_temp, cooling_time, pump_setting, pump_speed, pump_pressure, power_level, temperature_sensor_id_number, temperature_sensor_location, and/or the like.

In one embodiment, user programs may contain various user interface primitives, which may serve to update the BQ™ platform. Also, various accounts may require custom database tables depending upon the environments and the types of clients the BQ™ system may need to serve. It should be noted that any unique fields may be designated as a key field throughout. In an alternative embodiment, these tables have been decentralized into their own databases and their respective database controllers (i.e., individual database controllers for each of the above tables). Employing standard data processing techniques, one may further distribute the databases over several computer systemizations and/or storage devices. Similarly, configurations of the decentralized database controllers may be varied by consolidating and/or distributing the various database components 619*a-n*. The BQ™ system may be configured to keep track of various settings, inputs, and parameters via database controllers.

The BQ™ database may communicate to and/or with other components in a component collection, including itself, and/or facilities of the like. Most frequently, the BQ™ database communicates with the BQ™ component, other program components, and/or the like. The database may contain, retain, and provide information regarding other nodes and data.

The BQ™ Components

The BQ™ component 635 is a stored program component that is executed by a CPU. In one embodiment, the BQ™ component incorporates any and/or all combinations of the aspects of the BQ™ systems discussed in the previous figures. As such, the BQ™ component affects accessing, obtaining and the provision of information, services, transactions, and/or the like across various communications networks.

The BQ™ component may transform data collected by the cooling chest 10 or input signals received, e.g., from a mobile device, into commands for operating the cooler 10.

The BQ™ component enabling access of information between nodes may be developed by employing standard development tools and languages such as, but not limited to: Apache components, Assembly, ActiveX, binary executables, (ANSI) (Objective–) C (++), C# and/or .NET, database adapters, CGI scripts, Java, JavaScript, mapping tools, procedural and object oriented development tools, PERL, PHP, Python, shell scripts, SQL commands, web application server extensions, web development environments and libraries (e.g., Microsoft's ActiveX; Adobe AIR, FLEX & FLASH; AJAX; (D)HTML; Dojo, Java; JavaScript; jQuery(UI); MooTools; Prototype; script.aculo.us; Simple Object Access Protocol (SOAP); SWFObject; Yahoo! User Interface; and/or the like), WebObjects, and/or the like. In one embodiment, the BQ™ server employs a cryptographic server to encrypt and decrypt communications. The BQ™ component may communicate to and/or with other components in a component collection, including itself, and/or facilities of the like. Most frequently, the BQ™ component communicates with the BQ™ database, operating systems, other program components, and/or the like. The BQ™ may contain, communicate, generate, obtain, and/or provide program component, system, user, and/or data communications, requests, and/or responses.

Distributed BQ™ Embodiments

The structure and/or operation of any of the BQ™ node controller components may be combined, consolidated, and/or distributed in any number of ways to facilitate development and/or deployment. Similarly, the component collection may be combined in any number of ways to facilitate deployment and/or development. To accomplish this, one may integrate the components into a common code base or in a facility that can dynamically load the components on demand in an integrated fashion.

The component collection may be consolidated and/or distributed in countless variations through standard data processing and/or development techniques. Multiple instances of any one of the program components in the program component collection may be instantiated on a single node, and/or across numerous nodes to improve performance through load-balancing and/or data-processing techniques. Furthermore, single instances may also be distributed across multiple controllers and/or storage devices; e.g., databases. All program component instances and controllers working in concert may do so through standard data processing communication techniques.

The configuration of the BQ™ controller will depend on the context of system deployment. Factors such as, but not limited to, the budget, capacity, location, and/or use of the underlying hardware resources may affect deployment requirements and configuration. Regardless of if the configuration results in more consolidated and/or integrated program components, results in a more distributed series of program components, and/or results in some combination between a consolidated and distributed configuration, data may be communicated, obtained, and/or provided. Instances of components consolidated into a common code base from the program component collection may communicate, obtain, and/or provide data. This may be accomplished through intra-application data processing communication techniques such as, but not limited to: data referencing (e.g., pointers), internal messaging, object instance variable communication, shared memory space, variable passing, and/or the like.

If component collection components are discrete, separate, and/or external to one another, then communicating, obtaining, and/or providing data with and/or to other component components may be accomplished through inter-application data processing communication techniques such as, but not limited to: Application Program Interfaces (API) information passage; (distributed) Component Object Model ((D)COM), (Distributed) Object Linking and Embedding ((D)OLE), and/or the like), Common Object Request Broker Architecture (CORBA), Jini local and remote application program interfaces, JavaScript Object Notation (JSON), Remote Method Invocation (RMI), SOAP, process pipes, shared files, and/or the like. Messages sent between discrete component components for inter-application communication or within memory spaces of a singular component for intra-application communication may be facilitated through the creation and parsing of a grammar. A grammar may be developed by using development tools such as lex, yacc, XML, and/or the like, which allow for grammar generation and parsing capabilities, which in turn may form the basis of communication messages within and between components.

For example, a grammar may be arranged to recognize the tokens of an HTTP post command, e.g.:

w3c-post http:// . . . Value1 where Value1 is discerned as being a parameter because "http://" is part of the grammar syntax, and what follows is considered part of the post value. Similarly, with such a grammar, a variable "Value1" may be inserted into an "http://" post command and then sent. The grammar syntax itself may be presented as structured data that is interpreted and/or otherwise used to generate the parsing mechanism (e.g., a syntax description text file as processed by lex, yacc, etc.). Also, once the parsing mechanism is generated and/or instantiated, it itself may process and/or parse structured data such as, but not limited to: character (e.g., tab) delineated text, HTML, structured text streams, XML, and/or the like structured data. In another embodiment, inter-application data processing protocols themselves may have integrated and/or readily available parsers (e.g., JSON, SOAP, and/or like parsers) that may be employed to parse (e.g., communications) data. Further, the parsing grammar may be used beyond message parsing, but may also be used to parse: databases, data collections, data stores, structured data, and/or the like. Again, the desired configuration will depend upon the context, environment, and requirements of system deployment.

For example, in some implementations, the BQ™ controller may be executing a PHP script implementing a Secure Sockets Layer ("SSL") socket server via the information server, which listens to incoming communications on a server port to which a client may send data, e.g., data encoded in JSON format. Upon identifying an incoming communication, the PHP script may read the incoming message from the client device, parse the received JSON-encoded text data to extract information from the JSON-encoded text data into PHP script variables, and store the data (e.g., client identifying information, etc.) and/or extracted information in a relational database accessible using the Structured Query Language ("SQL"). An exemplary listing, written substantially in the form of PHP/SQL commands, to accept JSON-encoded input data from a client device via a SSL connection, parse the data to extract variables, and store the data to a database, is provided below:

```
<?PHP
header('Content-Type: text/plain');
// set ip address and port to listen to for incoming data
$address='192.168.0.100';
$port=255;
// create a server-side SSL socket, listen for/accept incoming communication $sock=socket_create(AF_INET, SOCK_STREAM, o);
socket_bind($sock, $address, $port) or die('Could not bind to address');
socket_listen($sock);
$client=socket_accept($sock);
// read input data from client device in 1024 byte blocks until end of message do {
$input=" ";
$input=socket_read($client, 1024);
$data.=$input;
} while($input !=" ");
// parse data to extract variables
$obj=json_decode($data, true);
// store input data in a database
mysql_connect("201.408.185.132",$DBserver,$password); // access database server
mysql_select("CLIENT_DB.SQL"); // select database to append
mysql_query("INSERT INTO UserTable (transmission)
VALUES ($data)"); // add data to UserTable table in a CLIENT database
mysql_close("CLIENT_DB.SQL"); // close connection to database
?>
```

Also, the following resources may be used to provide example embodiments regarding SOAP parser implementation:

http://www.xay.com/perl/site/lib/SOAP/Parser.html
http://publib.boulder.ibm.com/infocenter/tivihelp/v2r1/index.jsp?topic=/com.i
bm.IBMDI.doc/referenceguide295.htm
and other parser implementations:
http://publib.boulder.ibm.com/infocenter/tivihelp/v2r1/index.jsp?topic=/com.i
bm.IBMDI.doc/referenceguide259.htm all of which are hereby expressly incorporated by reference.

In order to address various issues and advance the art, the entirety of this application (including the Cover Page, Title, Headings, Field, Background, Summary, Brief Description of the Drawings, Detailed Description, Claims, Abstract, Figures, Appendices and/or otherwise) shows by way of illustration various embodiments in which the claimed inventions may be practiced. The advantages and features of the application are of a representative sample of embodiments only, and are not exhaustive and/or exclusive. They are presented only to assist in understanding and teach the claimed principles. It should be understood that they are not representative of all disclosed embodiments. As such, certain aspects of the disclosure have not been discussed herein. That alternate embodiments may not have been presented for a specific portion of the invention or that further undescribed alternate embodiments may be available for a portion is not to be considered a disclaimer of those alternate embodiments. It will be appreciated that many of those undescribed embodiments incorporate the same principles of the invention and others are equivalent. Thus, it is to be understood that other embodiments may be utilized and functional, logical, organizational, structural and/or topological modifications may be made without departing from the scope and/or spirit of the disclosure. As such, all examples and/or embodiments are deemed to be non-limiting throughout this disclosure. Also, no inference should be drawn regarding those embodiments discussed herein relative to those not discussed herein other than it is as such for purposes of reducing space and repetition. For instance, it is to be understood that the logical and/or topological structure of any combination of any program components (a component collection), other components and/or any present feature sets as described in the figures and/or throughout are not limited to a fixed operating order and/or arrangement, but rather, any disclosed order is exemplary and all equivalents, regardless of order, are contemplated by the disclosure. Furthermore, it is to be understood that such features are not limited to serial execution, but rather, any number of threads, processes, services, servers, and/or the like that may execute asynchronously, concurrently, in parallel, simultaneously, synchronously, and/or the like are contemplated by the disclosure. As such, some of these features may be mutually contradictory, in that they cannot be simultaneously present in a single embodiment. Similarly, some features are applicable to one aspect of the invention, and inapplicable to others. In addition, the disclosure includes other inventions not presently claimed. Applicant reserves all rights in those presently unclaimed inventions including the right to claim such inventions, file additional applications, continuations, continuations in part, divisions, and/or the like thereof. As such, it should be understood that advantages, embodiments, examples, functional, features, logical, organizational, structural, topological, and/or other aspects of the disclosure are not to be considered limitations on the disclosure as defined by the claims or limitations on equivalents to the claims. It is to be understood that, depending on the particular needs and/or characteristics of a BQ™ individual and/or enterprise user, database configuration and/or relational model, data type, data transmission and/or network framework, syntax structure, and/or the like, various embodiments of the BQ™ may be implemented that enable a great deal of flexibility and customization.

All statements herein reciting principles, aspects, and embodiments of the disclosure, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

Descriptions herein of circuitry and method steps and computer programs represent conceptual embodiments of illustrative circuitry and software embodying the principles of the disclosed embodiments. Thus the functions of the various elements shown and described herein may be provided through the use of dedicated hardware as well as hardware capable of executing software in association with appropriate software as set forth herein.

In the disclosure hereof any element expressed as a means for performing a specified function is intended to encompass any way of performing that function including, for example, a) a combination of circuit elements and associated hardware which perform that function or b) software in any form, including, therefore, firmware, microcode or the like as set forth herein, combined with appropriate circuitry for executing that software to perform the function. Applicants thus regard any means which can provide those functionalities as equivalent to those shown herein.

Similarly, it will be appreciated that the system and process flows described herein represent various processes which may be substantially represented in computer-readable media and so executed by a computer or processor, whether or not such computer or processor is explicitly shown. Moreover, the various processes can be understood as representing not only processing and/or other functions but, alternatively, as blocks of program code that carry out such processing or functions.

The methods, systems, computer programs and mobile devices of the present disclosure, as described above and shown in the drawings, among other things, provide for improved beverage cooling methods, systems and machine readable programs for carrying out the same. It will be apparent to those skilled in the art that various modifications and variations can be made in the devices, methods, software programs and mobile devices of the present disclosure without departing from the spirit or scope of the disclosure. Thus, it is intended that the present disclosure include modifications and variations that are within the scope of the subject disclosure and equivalents.

What is claimed is:

1. A chest for quenching beverages, including:

a tank for holding a chilled mixture of ice and water;

an ice maker adapted for making ice having an output for ejecting ice into a conduit in fluid communication with the tank; and a plurality of quench trays disposed above the tank for holding containers of beverages located in first and second positions and which are filled with the cold water by way of a conduit in fluid communication with the tank; the quench trays including a compartment defined by a bottom and a plurality of walls, and defining therein a plurality of rows for aligning and containing a plurality of beverage containers, at least one of the trays further including at least one drain orifice configured to guide water out of the quench tray.

2. The chest of claim 1, wherein at least one of the quench trays includes a pull out drawer mounted on a track, and further wherein the pull out drawer is adapted and configured to evacuate cooling water contained therein when the drawer is pulled outwardly from a retracted position.

3. The chest of claim 1, wherein each tray defines a plurality of openings therethrough for guiding water out of the quench tray.

4. The chest of claim 1, wherein at least one of the trays defines the plurality of rows therein by way of a plurality of dividers including raised nodes configured for the placement of a plurality of containers of beverages therebetween.

5. The chest of claim 4, wherein the dividers include a grate that is configured to be received by a longitudinal groove formed along the base of the divider, and further wherein the grate can be lifted out of the groove and rotated from an upwardly extending position to a horizontal resting position.

6. The chest of claim 1 wherein an upper quench tray is stationary, and a quench tray below the upper tray can be pulled out through the side of the chest.

7. The chest of claim 1, further comprising a control system for controlling the cooling of the chest.

8. The chest of claim 7, wherein the flow of cold water to each tray is controlled by the control system in response to temperature data received from the tray.

9. The chest of claim 7, wherein the flow of cold water to each tray is controlled by the control system in response to opening or closing one of the trays.

10. The chest of claim 7, wherein the flow of cold water to each tray is controlled by the control system in response to data received from the tray indicating that the contents of the tray has changed.

11. The chest of claim 10, wherein at least one of the quench trays includes a plurality of temperature sensors in different locations across the tray, the temperature sensors being configured to provide temperature data to the controller, and further wherein the controller is configured to adjust the amount of cooling water directed to each tray in response to temperature data received from the temperature sensors.

12. The chest of claim 1, wherein cooling is effectuated by directing a flow of chilled water over the beverage containers.

13. The chest of claim 12, wherein the flow of cooling water causes the beverage containers to rotate in place to enhance heat transfer from the beverage containers to the cooling water.

14. The chest of claim 2, wherein the quench tray drawer is disconnected from its source of cooling water when it is pulled out.

15. The chest of claim 14, wherein the source of cooling water for the quench tray drawer includes a fitment proximate the back of the drawer that is received by a cooling water supply line when the drawer is closed.

16. The chest of claim 1, wherein the chest is configured to be powered by a gas tank.

17. The chest of claim 16, wherein the chest is powered by a gas from the gas tank.

18. The chest of claim 17, wherein the gas includes at least one of: propane, natural gas and ethanol.

19. The chest of claim 1, wherein the chest is adapted to recapture chilled water for circulation of the chilled water into the ice maker.

20. The chest of claim 1, further configured with a plurality of wheels attached to the bottom wall of the cooling chest.

* * * * *